US008213820B2

(12) United States Patent
Atsumi et al.

(10) Patent No.: US 8,213,820 B2
(45) Date of Patent: Jul. 3, 2012

(54) MEASURING APPARATUS, MEASURING METHOD AND IMAGE FORMING APPARATUS

(75) Inventors: Tetsuya Atsumi, Susono (JP); Kunitoshi Aoki, Tokyo (JP); Yukio Nagase, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 447 days.

(21) Appl. No.: 12/498,523

(22) Filed: Jul. 7, 2009

(65) Prior Publication Data

US 2010/0021196 A1 Jan. 28, 2010

(30) Foreign Application Priority Data

Jul. 22, 2008 (JP) ..... 2008-189046
Apr. 21, 2009 (JP) ..... 2009-103360

(51) Int. Cl.
*G03G 15/00* (2006.01)

(52) U.S. Cl. ..... 399/74; 399/389

(58) Field of Classification Search ..... 399/74, 399/389

See application file for complete search history.

(56) References Cited

U.S. PATENT DOCUMENTS

| | | | | |
|---|---|---|---|---|
| 2,956,487 | A | 10/1960 | Giaimo et al. | 95/1.7 |
| 4,082,445 | A | 4/1978 | Steiner | 355/14 |
| 6,853,817 | B2 | 2/2005 | Kazuo | 399/49 |
| 6,879,788 | B2 | 4/2005 | Ito et al. | |
| 7,512,349 | B2 | 3/2009 | Itoh et al. | |
| 2008/0075476 | A1 * | 3/2008 | Nakazato et al. | 399/15 |

FOREIGN PATENT DOCUMENTS

| | | | |
|---|---|---|---|
| JP | 4-156479 | A | 5/1992 |
| JP | 8-327331 | A | 12/1996 |
| JP | 2003/76129 | A | 3/2003 |

* cited by examiner

*Primary Examiner* — David Gray
*Assistant Examiner* — Roy Y Yi
(74) *Attorney, Agent, or Firm* — Fitzpatrick, Cella, Harper & Scinto

(57) ABSTRACT

A toner amount measuring unit irradiates a toner image formed on an image carrying member with light, and an image capturing unit captures an image of a reflected waveform according to light reflected by the toner image. Then, an amount of applied toner is calculated based on the peak position or peak height of the reflected waveform in accordance with information associated with the density of the toner image to be formed.

16 Claims, 27 Drawing Sheets

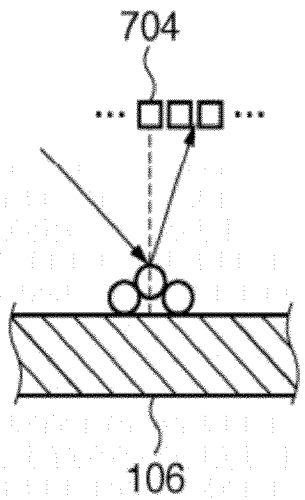
FIG. 14A
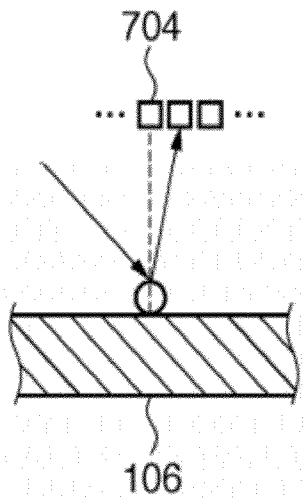
FIG. 14B
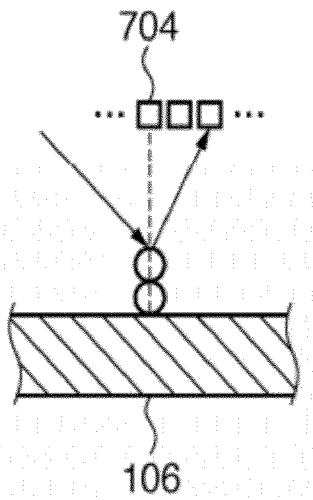
FIG. 14C
FIG. 14D

MEASURING APPARATUS, MEASURING METHOD AND IMAGE FORMING APPARATUS

BACKGROUND OF THE INVENTION

1. Field of the Invention

The present invention relates to a measuring apparatus, measuring method and image forming apparatus and, more particularly, to measurement of an amount of toner applied on an image carrying member of an image forming apparatus.

2. Description of the Related Art

In an electrophotographic image forming apparatus, even when image formation is made under the same conditions, the density of a formed image is erratic. This is due to the influence of variations of various image forming parameters such as those of an amount of electrical charge of toner, the sensitivity of a photosensitive member, and efficiency of transferring toner, and variations of environmental conditions such as temperature and humidity.

Hence, the density or height of a toner image developed on a photosensitive member or intermediate transferring member is detected, and various image forming parameters such as supply and a charging potential of toner, an amount of exposure light, and a developing bias are feedback-controlled based on the detection result.

For example, the invention of U.S. Pat. No. 2,956,487 detects a potential formed by an electrostatic latent image formed by exposure on a photosensitive member or the image density of a toner image obtained by developing the electrostatic latent image, compares the detection value with a reference value, and controls the image density in accordance with the comparison result. Also, the invention of U.S. Pat. No. 4,082,445 compares a difference between the amount of reflected light on a non-image region on a photosensitive member and that of a referential toner image with a reference value, and supplies toner in accordance with the comparison result.

FIG. 1 is a view showing a general method of measuring the amount of reflected light. A patch sensor 25 includes a light-emitting diode (LED) 25*a* which emits near infrared light as a light-emitting element, and a photodiode (PD) 25*b* as a photoreceptor, and measures the amount of reflected light of a referential toner image 26. In other words, the sensor 25 measures the amount of applied toner mainly using the amount of specular reflected light.

FIG. 2 is a graph showing the sensor output of a 530 spectrodensitometer available from X-Rite. As shown in FIG. 2, the amount of applied toner can be measured based on the sensor output within a density range from 0.6 to 0.8. However, a change in amount of reflected light with respect to a change in toner density is slight in a high density range. That is, it is difficult to accurately measure the amount of applied toner from the difference between the amounts of reflected light over the full density range.

Japanese Patent Laid-Open No. 2003-076129 discloses the invention which measures the amount of applied toner in a high density range by introducing polarized light. FIG. 3 is a view showing the arrangement of a patch sensor 25' of Japanese Patent Laid-Open No. 2003-076129. The patch sensor 25' includes PDs 25*c* and 25*d* and prisms 25*e* and 25*f* in addition to the LED 25*a* which emits near infrared light and the PD 25*b*.

Light emitted by the LED 25*a* is separated by the prism 25*e* into components (S wave) which oscillate in a direction perpendicular to an incidence plane and components (P wave) which oscillate in a direction parallel to the incidence plane.

The separated S wave enters the PD 25*c*, and the separated P wave strikes the referential toner image 26. The P wave which strikes the referential toner image 26 is diffused-reflected, and some components are converted into S wave components. The reflected light from the referential toner image 26 is separated into S and P waves by the prism 25*f*. The separated S wave enters the PD 25*d*, and the separated P wave enters the PD 25*b*.

FIG. 4 is a graph showing the output (curve B) from the PD 25*b*, and the output (curve D) from the PD 25*d*. The amount of specular reflected light (P wave) represented by curve B is corrected by the amount of diffused light (S wave), thus obtaining the amount of reflected light (curve H) in which the influence of diffused reflection is removed. With this method, the amount of applied toner can be measured up to a density of about 1.0, but it is impossible to measure a higher density.

On the other hand, a method using a laser displacement sensor has also been proposed (for example, Japanese Patent Laid-Open No. 4-156479 and Japanese Patent Laid-Open No. 8-327331). FIGS. 5A and 5B are views showing a laser displacement sensor 24, and FIG. 6 is a graph showing the measurement result of the amount of applied toner by the laser displacement sensor 24.

The laser displacement sensor 24 can measure a change in height (thickness) of a laminated toner layer (see FIG. 5A). However, in a dot pattern or line pattern on a highlight range shown in FIG. 5B, toner layers become discontinuous. That is, as shown in FIG. 6, the amount of applied toner in a density range in which toner layers are continuous can be accurately measured. However, the amount of applied toner in a low density range in which toner layers become discontinuous cannot be accurately measured.

As described above, when the patch sensor is used, it is difficult to measure the amount of applied toner in a high density range, and when the laser displacement sensor is used, it is difficult to measure the amount of applied toner in a low density range. Therefore, in order to accurately measure the amount of applied toner over the full density range, both the patch sensor and laser displacement sensor are used, so that the patch sensor is used for a range other than the high density range, and the laser displacement sensor is used for the high density range. However, this results in increases in cost and size of an image forming apparatus.

SUMMARY OF THE INVENTION

In one aspect, a method for measuring a toner amount of a toner image formed on an image carrying member of an image forming apparatus, the method comprises: irradiating the toner image with light; capturing the toner image using a plurality of photoreceptors arranged adjacent to each other; acquiring information associated with peak positions of reflected waveforms and information associated with light amounts of the reflected waveforms from data obtained by receiving light reflected by the toner image by the plurality of photoreceptors; and calculating the toner amount based on at least one of: the peak position, the light amount and information associated with a density of the toner image to be formed.

According to the aspect, the satisfactory measurement result of the amount of applied toner over a broad range from a low density range to a high density range is obtained.

Further features of the present invention will become apparent from the following description of exemplary embodiments with reference to the attached drawings.

BRIEF DESCRIPTION OF THE DRAWINGS

FIGS. 14A to 14D are views illustrating a laminated state of toner.

DESCRIPTION OF THE EMBODIMENTS

A measuring apparatus of an amount of applied toner and an image forming apparatus according to embodiments of the present invention will be described hereinafter with reference to the drawings.

First Embodiment

[Apparatus Arrangement]

Figure 1:
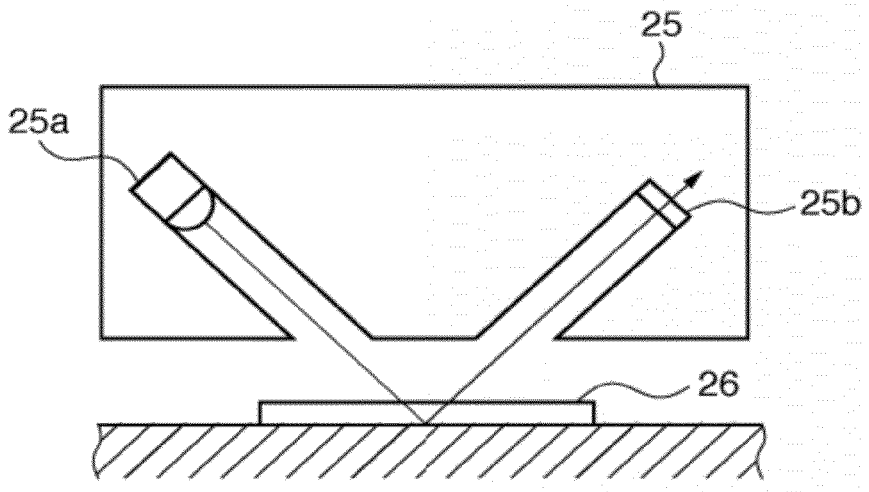
FIG. 1 PRIOR ART
FIG. 1 is a view showing the general method of measuring the amount of reflected light.
Figure 2:
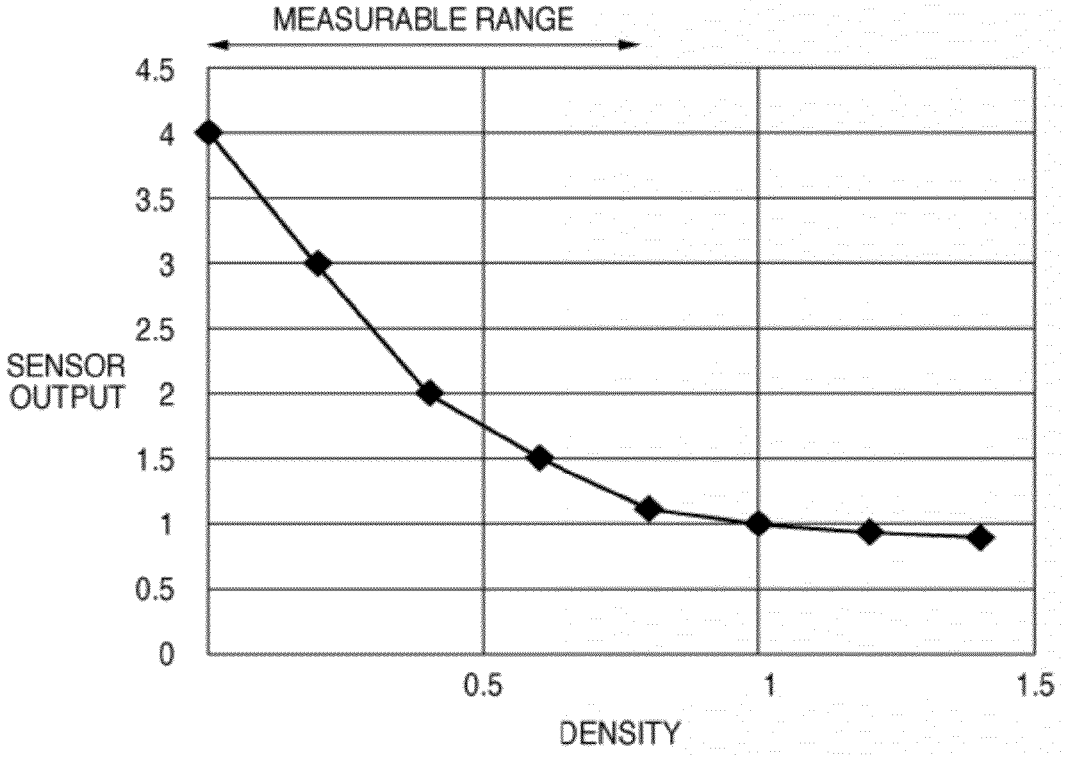
FIG. 2 PRIOR ART
FIG. 2 is a graph showing the sensor output of a 530 spectrodensitometer available from X-Rite.
Figure 3:
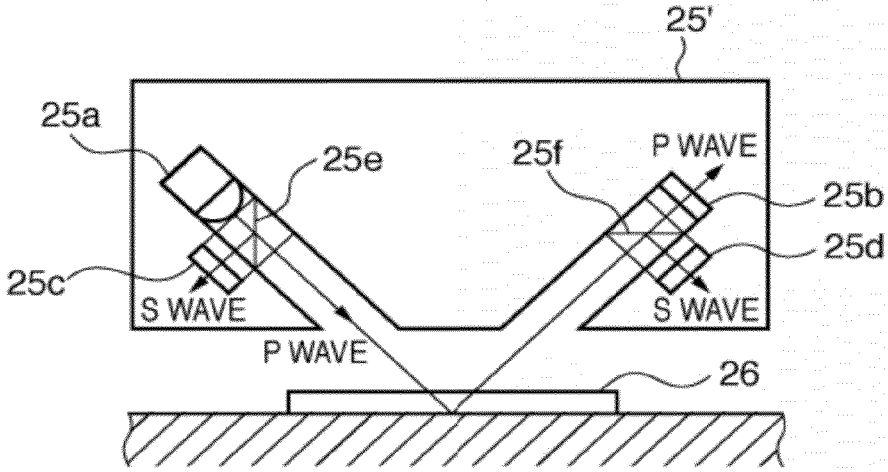
FIG. 3 PRIOR ART
FIG. 3 is a view showing the arrangement of a patch sensor in general.
Figure 4:
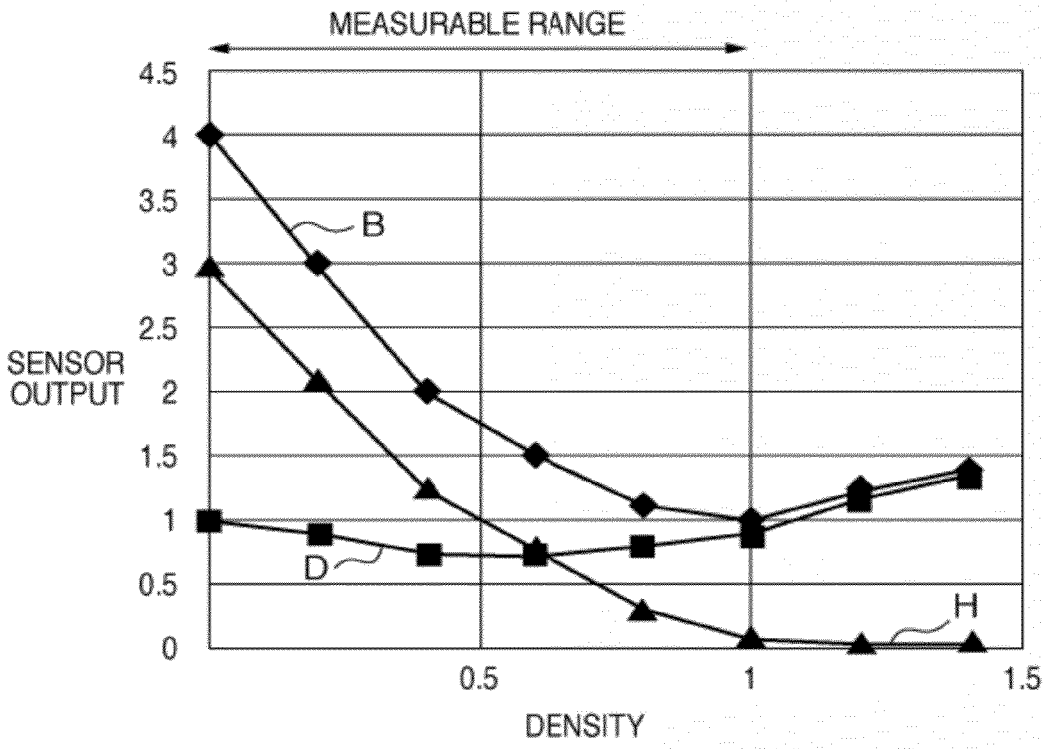
FIG. 4 PRIOR ART
FIG. 4 is a graph showing the output from a photodiode.
Figures 5A, 5B:
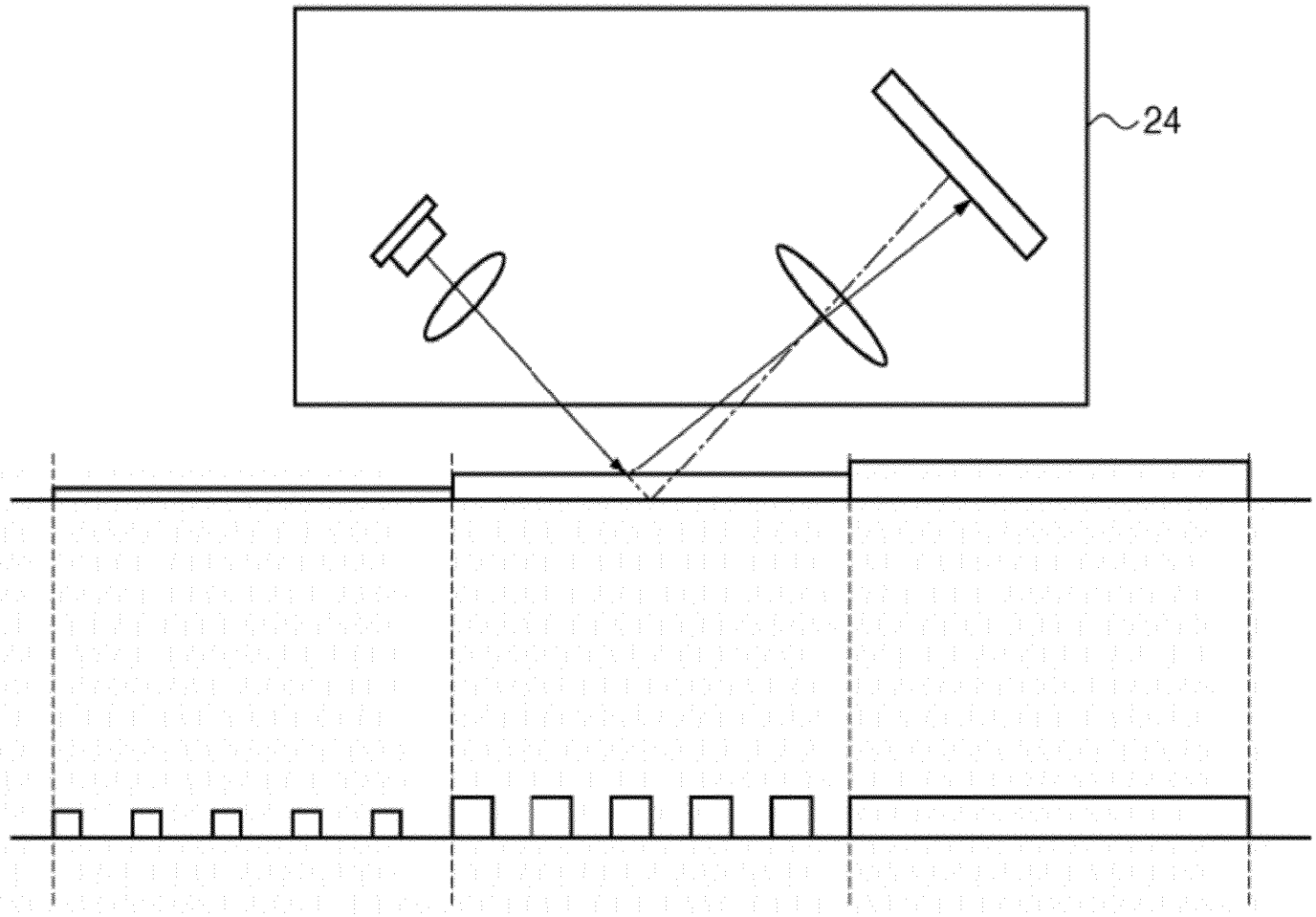
FIG. 5A PRIOR ART
FIG. 5B PRIOR ART
FIGS. 5A and 5B are views showing a laser displacement sensor.
Figure 6:
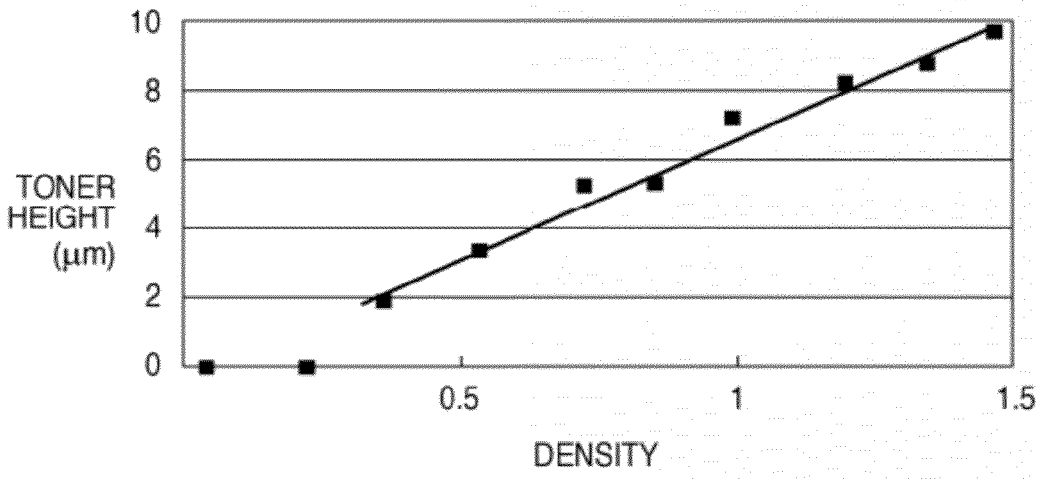
FIG. 6 PRIOR ART
FIG. 6 is a graph showing the measurement result of the amount of applied toner by the laser displacement sensor.
Figure 7:
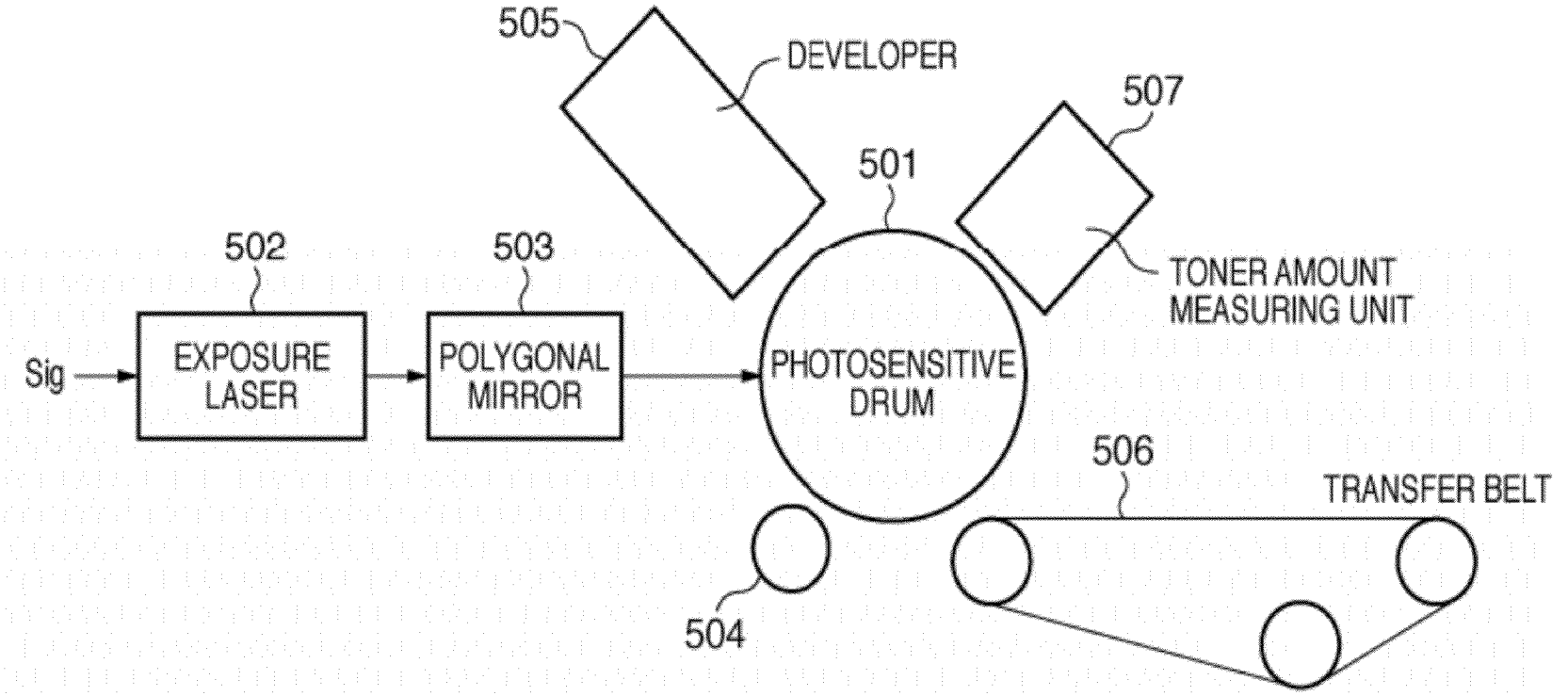
FIG. 7 is a block diagram showing the arrangement of an image forming apparatus according to an embodiment.

FIG. 7 is a block diagram showing the arrangement of an image forming apparatus according to an embodiment.

An exposure laser 502 emits laser light in accordance with a pulse-width-modulated input signal Sig. The surface of a photosensitive drum 501 as an image carrying member is uniformly charged by a primary charger 504. In this embodiment, a corona charger is arranged as the primary charger. This primary charger 504 is applied with a discharging bias of a DC current of −900 μA and a grid bias of a DC voltage of −780 V, and the outer circumferential surface of the photosensitive drum 501 is uniformly charged at nearly −700 V.

The laser light output from the exposure laser 502 is scanned by a polygonal mirror 503 in a main scan direction, thus forming an electrostatic latent image on the surface of the photosensitive drum 501. The electrostatic latent image is developed by a developer 505 to form a toner image. Thus, the exposure laser 502 and developer 505 can be configured as an image forming unit which forms a toner image. The toner image is transferred onto a transfer belt 506 as an intermediate transferring member, and is then transferred and fixed on a print sheet, although not shown. Note that the main scan direction indicates a direction which is perpendicular to the moving direction of the photosensitive drum 501 and is parallel to the surface of the photosensitive drum 501. A sub-scan direction indicates a direction which is parallel to the moving direction of the photosensitive drum 501.

A toner amount measuring unit 507 is arranged near the developer 505, and measures the amount of applied toner of the toner image on the photosensitive drum 501, which is developed by the developer 505.

Note that the amount of applied toner may be measured on the transfer belt 506 after the toner image is transferred from the photosensitive drum 501 onto the transfer belt 506. Some image forming apparatuses directly transfer a toner image from the photosensitive drum 501 onto a print sheet without using the transfer belt 506. Furthermore, the amount of applied toner may be measured on a print sheet in place of the photosensitive drum 501 or transfer belt 506. Hence, the photosensitive drum 501, transfer belt 506, or print sheet, which supports a toner image before transfer or fixing will be referred to as a support member hereinafter.

Control Unit

Figure 8:
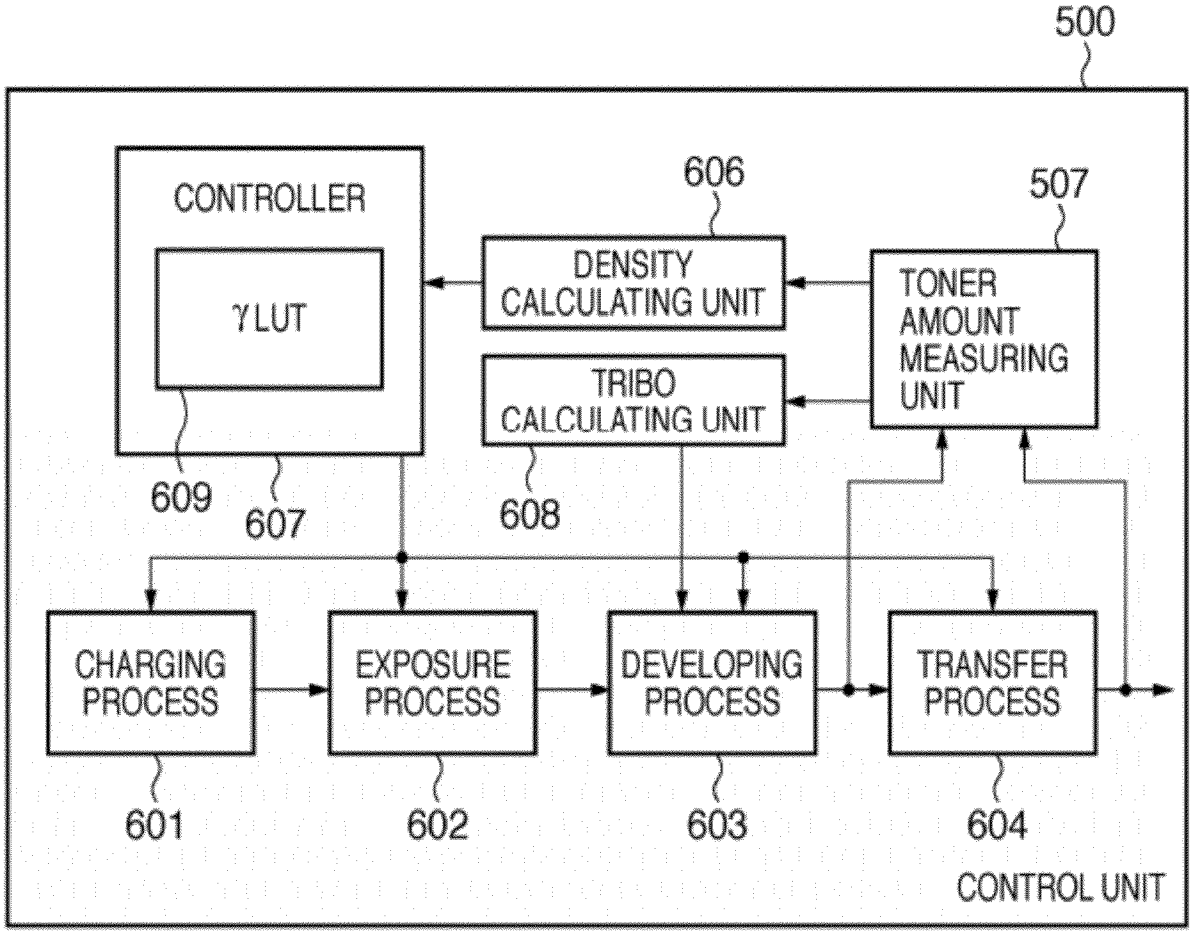
FIG. 8 is a block diagram showing the arrangement of a control unit of the image forming apparatus.

FIG. 8 is a block diagram showing the arrangement of a control unit 500 of the image forming apparatus.

The toner amount measuring unit 507 of the control unit 500 measures the amount of applied toner of each toner patch formed on the photosensitive drum 501 (or transfer belt 506). A density calculating unit 606 calculates density data from the measured amount of applied toner. A controller 607 compares the calculated density data (actually measured value) with density data (theoretical value) with respect to a signal value Sig of each toner patch, and corrects a gamma table (γLUT) 609 used to correct nonlinearity of an image density based on the comparison result.

The controller 607 controls a charging process 601, exposure process 602, developing process 603, and transfer process 604 as respective processes of the image forming apparatus based on the calculated density data.

The amount of applied toner on the transfer belt 506 may be measured, a tribo amount may be calculated from the measured amount of applied toner using a tribo calculating unit 608, and the calculated tribo amount may be used in feedback control of the developing process 603. Note that "tribo" is defined by a ratio Q/M of an electrical charge Q of toner generated by friction between the toner and carrier upon stirring a developing agent, and a mass M of that toner.

A mass M/S per unit area is calculated from an amount $d_t$ of applied toner (a height of each toner patch) measured by the toner amount measuring unit 507 using:

$$M/S=\sqrt{2}\times\pi\rho_t d_t/6 \quad (1)$$

Next, an electrical charge Q/S per unit area is calculated from a latent image potential difference ΔV before and after development measured by a surface potentiometer (not shown) using:

$$Q/S=\Delta V/\{(d_t/2\epsilon_0\epsilon_t)+(d_d/\epsilon_0\epsilon_c)\} \quad (2)$$

Then, a tribo amount Q/M is calculated using:

$$Q/M=Q/S/M/S \quad (3)$$

This Q/M is fed back to the developing process.

Toner Amount Measuring Unit

Figure 9:
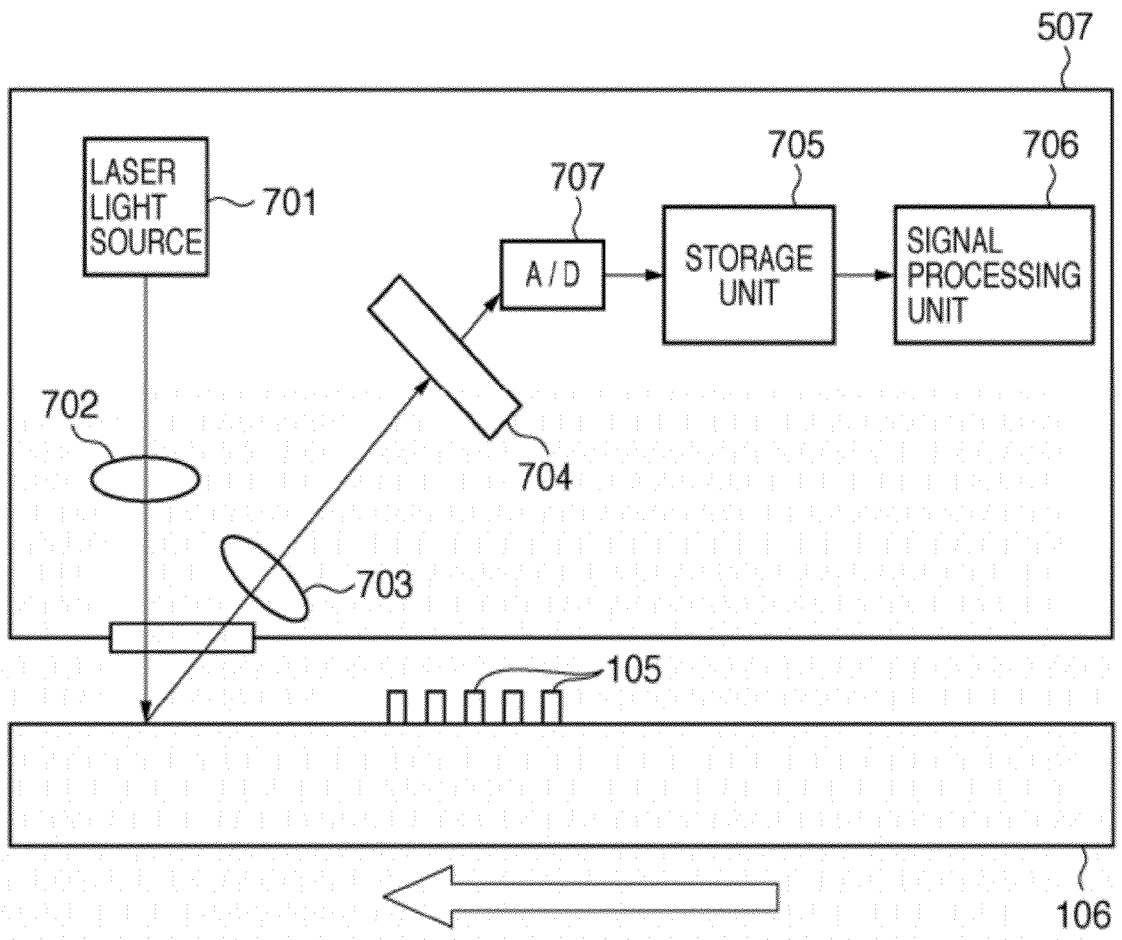
FIG. 9 is a block diagram showing the arrangement of a toner amount measuring unit.

FIG. 9 is a block diagram showing the arrangement of the toner amount measuring unit 507.

A toner patch 105 and support member 106 are irradiated with laser light (measurement light) emitted by a laser light source 701 via a condensing lens 702 which condenses the laser light into a spot. Reflected light from the toner patch 105 or support member 106 forms an image on a line sensor 704 by a light-receiving lens 703. Therefore, the line sensor 704 captures images of reflected light according to the thickness of the toner patch 105. Note that the present invention is not limited to a one-dimensional line sensor, and a two-dimensional (2D) image sensor may be used. Note that the laser light source 701 or an arrangement that combines the laser light source 701 and condensing lens 702 corresponds to a light irradiating unit. Also, the line sensor 704 or an arrangement that combines the line sensor 704 and light-receiving lens 703 (condensing lens) corresponds to an image capturing unit.

A signal indicating a reflected waveform output from the line sensor 704 is converted into a digital signal by an analog-to-digital (A/D) converter 707, and the digital signal is stored in a storage unit 705. A signal processing unit 706 calculates the amount of applied toner from the reflected waveform data stored in the storage unit 705.

The surface of the support member 106 on which no toner patch 105 is formed is irradiated with measurement light, and data of that reflected waveform (support member reflected waveform) is stored in the storage unit 705. Then, the support member 106 is moved in a direction of an arrow, the surface of each toner patch 105 is irradiated with measurement light, and data of its reflected waveform (toner reflected waveform) is stored in the storage unit 705.

Processing (to be described later) of the signal processing unit 706 is applied to the support member reflected waveform and toner reflected waveform data to calculate a difference between the peak positions of the support member reflected waveform and toner reflected waveform (a feature point; to be referred to as a position difference hereinafter), and a difference between the amounts of reflected light (to be referred to as a light amount difference hereinafter). Then, the amount of applied toner is calculated from the position difference and light amount difference. Note that the light amount difference is calculated from a difference between the peak heights of the reflected waveforms. In addition or alternatively, a difference between the areas of the reflected waveforms may be used as the light amount difference.

Figure 28A:
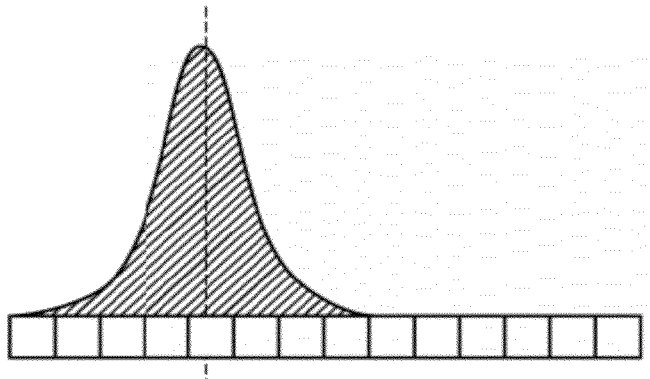
FIGS. 28A and 28B are views for explaining output signals of reflected waveforms.
Figure 28B:
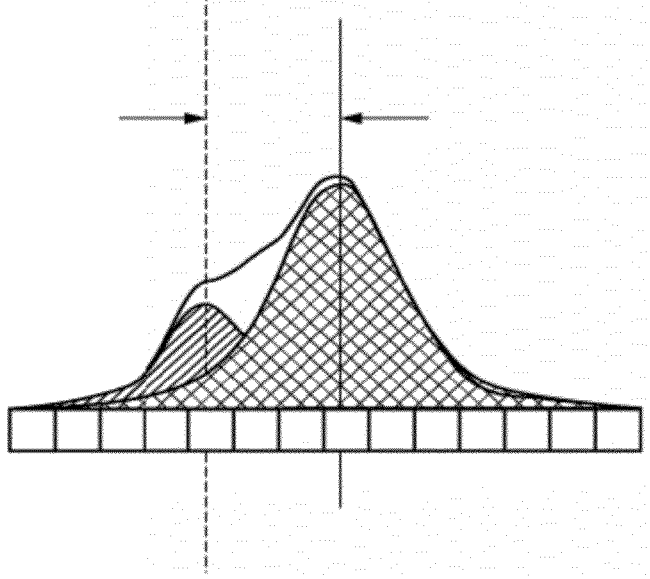

As shown in FIGS. 28A and 28B, the reflected waveform is received by a plurality of photoreceptors which are arranged adjacent to each other, and the output signals of the reflected waveform are output as electrical signals according to the light-receiving amounts from the respective photoreceptors. The position difference is detected depending on which of the plurality of photoreceptors outputs a highest signal (light-receiving position). Since the light-receiving position changes according to the height of an object, the position difference allows accurate measurement of the amount of applied toner in a high density range in which toner layers are continuous, but does not allow accurate measurement of the amount of applied toner in a low density range in which the toner layers are discontinuous. Conversely, the light amount difference changes under the influence of the amount of reflected light from an object. For this reason, in a low density range in which the area of toner on the support member 106 gradually increases, the light amount difference allows accurate measurement of the amount of applied toner. On the other hand, in a high density range in which the toner layers are continuous, since the amount of reflected light from an object rarely changes, it is difficult to accurately measure the amount of applied toner based on the light amount difference.

FIGS. 27A to 27F are graphs of the reflected waveforms when the toner density changes from a low density to a high density.

Figure 27A:
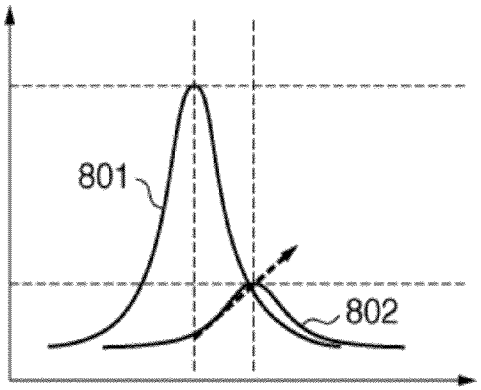
FIGS. 27A to 27F are graphs of reflected waveforms when the toner density changes from a low density to a high density.
Figure 27B:
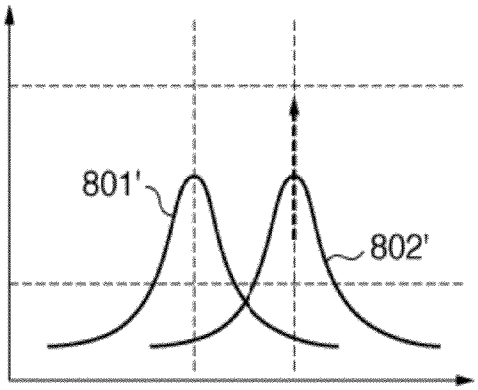
Figure 27C:
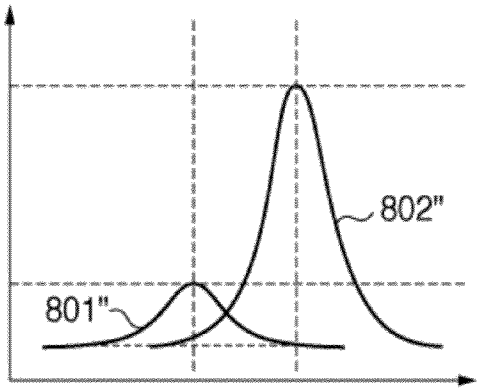
Figure 27D:
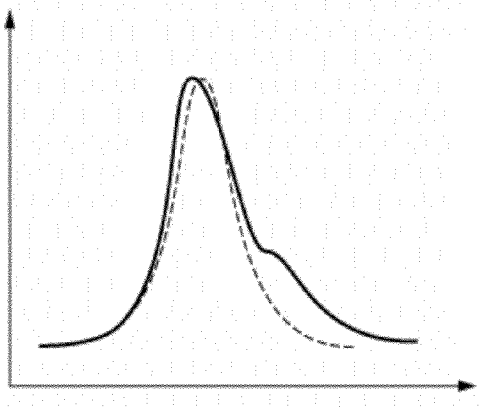

In a low density range, a reflected waveform 801 from the support member 106 and a reflected waveform 802 from a toner layer shown in FIG. 27A are output as a composite waveform indicated by the solid curve in FIG. 27D. As the toner layer increases, the peak of an output waveform moves in a direction indicated by a broken arrow in FIG. 27A. A waveform indicated by the broken curve in FIG. 27D is that after curve fitting to be described later.

Figure 27E:
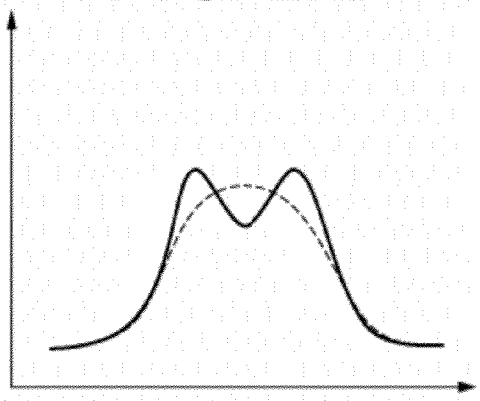

In a middle density range, a composite waveform indicated by the solid curve in FIG. 27E of a reflected waveform 801' from the support member 106 and a reflected waveform 802' from the toner layer in FIG. 27B, and a waveform after curve fitting, which is indicated by the broken curve in FIG. 27E, are respectively output. In the middle density range, although the amount of reflected light from the toner layer increases in contrast to a decrease in amount of reflected light from the support member 106, the peak position of the reflected waveform from the toner layer rarely changes, and the light amount increases, as indicated by a broken arrow in FIG. 27B.

Figure 27F:
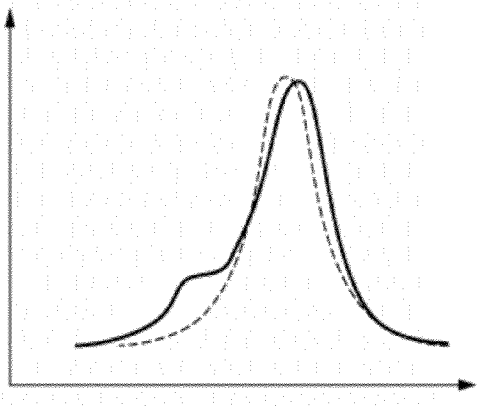

Likewise, in a high density range, a composite waveform indicated by the solid curve in FIG. 27F of a reflected waveform 801" from the support member 106 and a reflected waveform 802" from the toner layer in FIG. 27C, and a waveform after curve fitting, which is indicated by the broken curve in FIG. 27F, are respectively output.

Figure 29A:
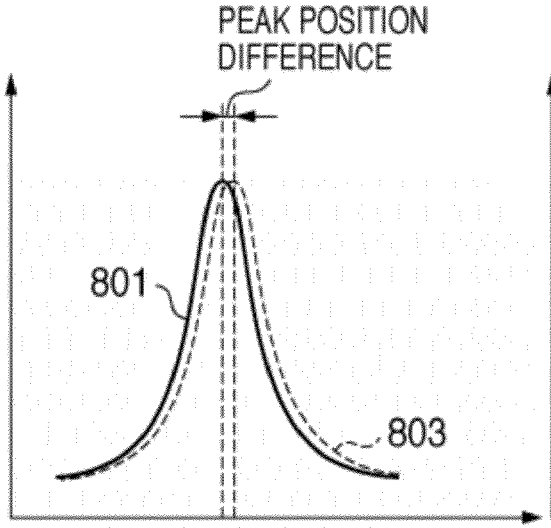
FIGS. 29A to 29C are graphs for explaining the method of calculating a peak position.
Figure 29B:
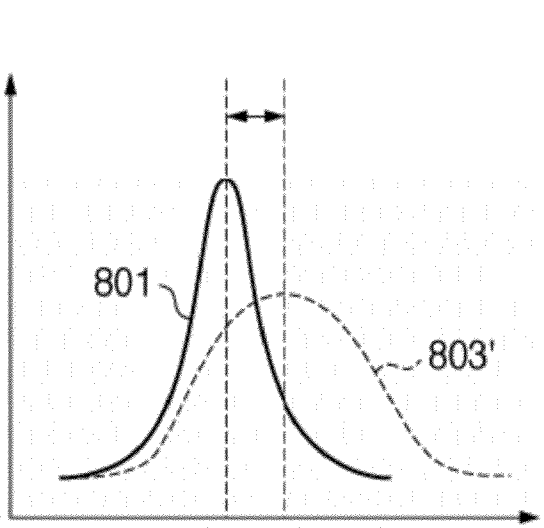
Figure 29C:
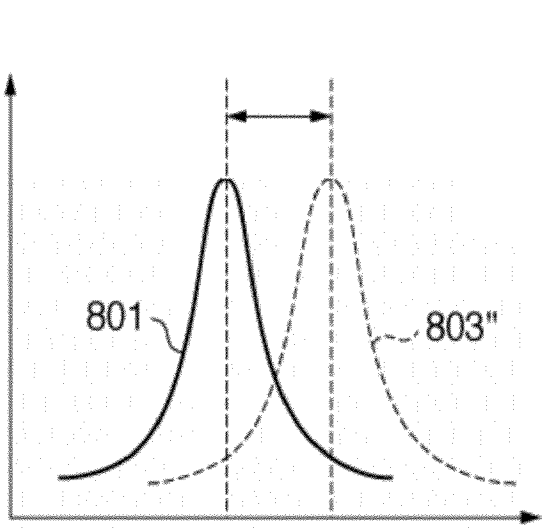

FIGS. 29A to 29C are graphs for calculating the peak position from the reflected waveform from the support member 106 as a reference value and the waveforms after curve fitting described using FIGS. 27D to 27F.

FIGS. 29A, 29B, and 29C respectively show the reflected waveform 801 from the support member 106, and a fitting curve 803 at a low density, a fitting curve 803' at a middle density, and a fitting curve 803" at a high density. The height of a toner image is calculated by setting the output value of the peak position of the reflected waveform 801 from the support member 106 to be a reference value (zero point) and detecting the moving amount of the peak position of the fitting curve obtained from the target toner image.

Figure 10:
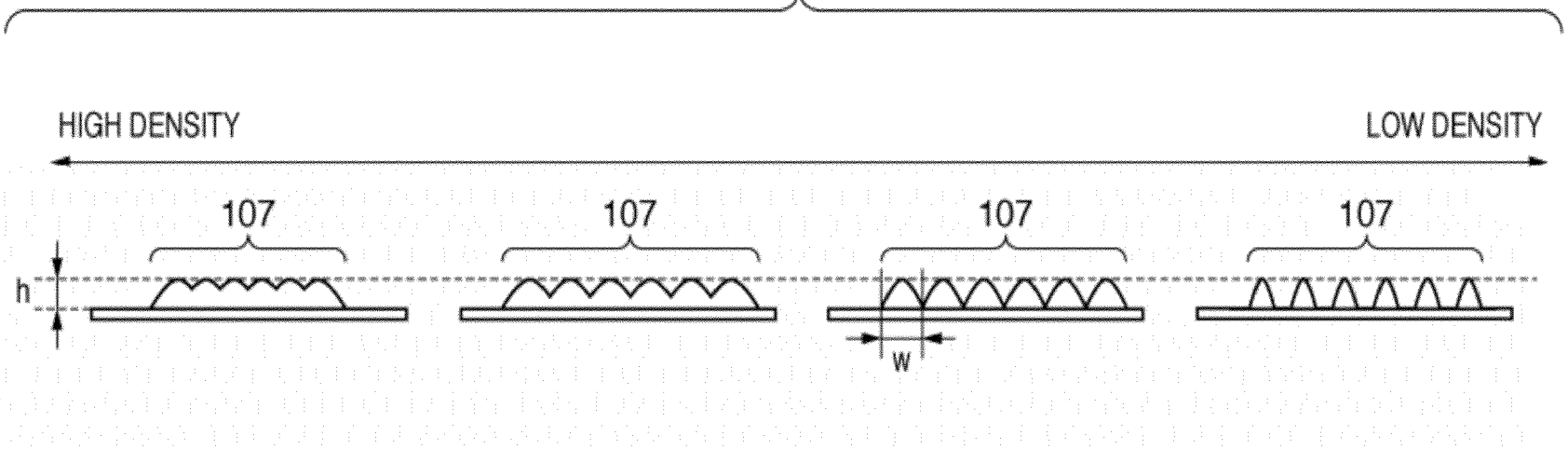
FIG. 10 is a view for explaining the measuring method of the amount of applied toner on toner patches formed by an area coverage modulation method.

FIG. 10 is a view for explaining a method of measuring the amounts of applied toners of toner patches 107 formed by an area coverage modulation method.

As shown in FIG. 10, applied toner layers of the toner patches 107 formed by the area coverage modulation method have a constant height h, and their widths W change depending on the densities. FIG. 10 expresses the toner patches 107 which have a higher density on the left end and a lower density on the right end.

Signal Processing Unit

Figure 11:
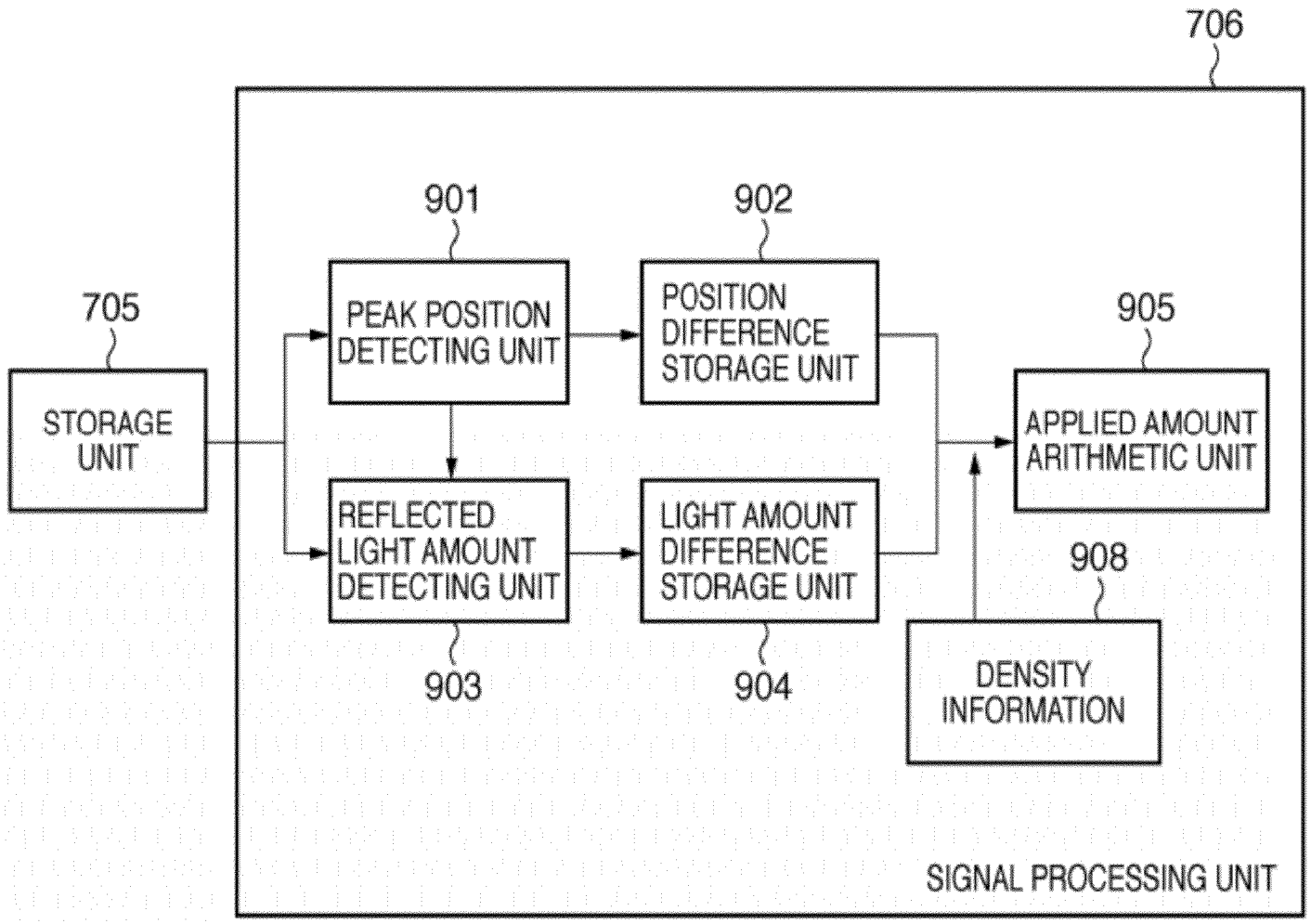
FIG. 11 is a block diagram showing the arrangement of a signal processing unit.

FIG. 11 is a block diagram showing the arrangement of the signal processing unit 706.

A peak position detecting unit 901 detects the peak position from the support member reflected waveform data stored in the storage unit 705. Furthermore, the peak position detecting unit 901 detects the peak position from the toner reflected waveform data corresponding to each toner patch 105 stored in the storage unit 705. Then, the peak position detecting unit 901 stores a difference between the peak position of the support member 106 and that of the toner patch 105 (a difference for each pixel of the line sensor 704) in a position difference storage unit 902 as a position difference. Note that an eccentricity component of the support member 106 may be calculated from peak positions of two points of the support member 106 before and after a toner patch 105, and the peak position of the toner patch may be corrected by removing the eccentricity component from the peak position of the toner patch, thus improving the calculation precision of the peak position of the toner patch.

Note that the calculation and storage of the position difference are made for all the toner patches 105. Also, each position difference is converted into a toner height (μm) by multiplying the position difference by a coefficient determined based on the geometric arrangement of the toner amount measuring unit 507. When the support member 106 of this embodiment is transparent to laser light (having a wavelength of 780 nm and a spot size of 50 μm) as measurement light, a thickness corresponding to the film thickness of the support member 106 has to be excluded. In this case, an apparent film thickness derived due to a difference between the refractive indices of air and a material of the support member 106 is excluded.

A reflected light amount detecting unit (light amount calculating unit) 903 calculates peak heights of the support member reflected waveform and each toner reflected waveform extracted by the peak position detecting unit 901. Then, the reflected light amount detecting unit 903 stores a difference between the peak height of the support member 106 and that of each toner patch 105 in a light amount difference storage unit 904 as a light amount difference. Note that an eccentricity component of the support member 106 may be calculated from peak positions of two points of the support member 106 before and after a toner patch 105, and the peak height of the toner patch may be corrected by removing the eccentricity component from the peak height, thus improving the calculation precision of the peak height of the toner patch. Note that the calculation and storage of the light amount difference are made for all the toner patches 105.

As a method of detecting the position and height of a peak from a reflected waveform, the following method is available. Curve fitting is applied to the reflected waveform by the method of least squares using a Gaussian function. The position and height of the peak are calculated from parameters of the Gaussian function after curve fitting. The Gaussian function is a bell-shaped function having x=μ as the center, as given by:

$$f(x)=\{A/\sqrt{(2\pi\sigma^2)}\}\cdot\exp\{-(x-\mu)^2/2\sigma^2\}+C \quad (4)$$

where μ is a peak position,

σ is a parameter associated with the width of a peak, and

A is an amplitude.

Figure 12:
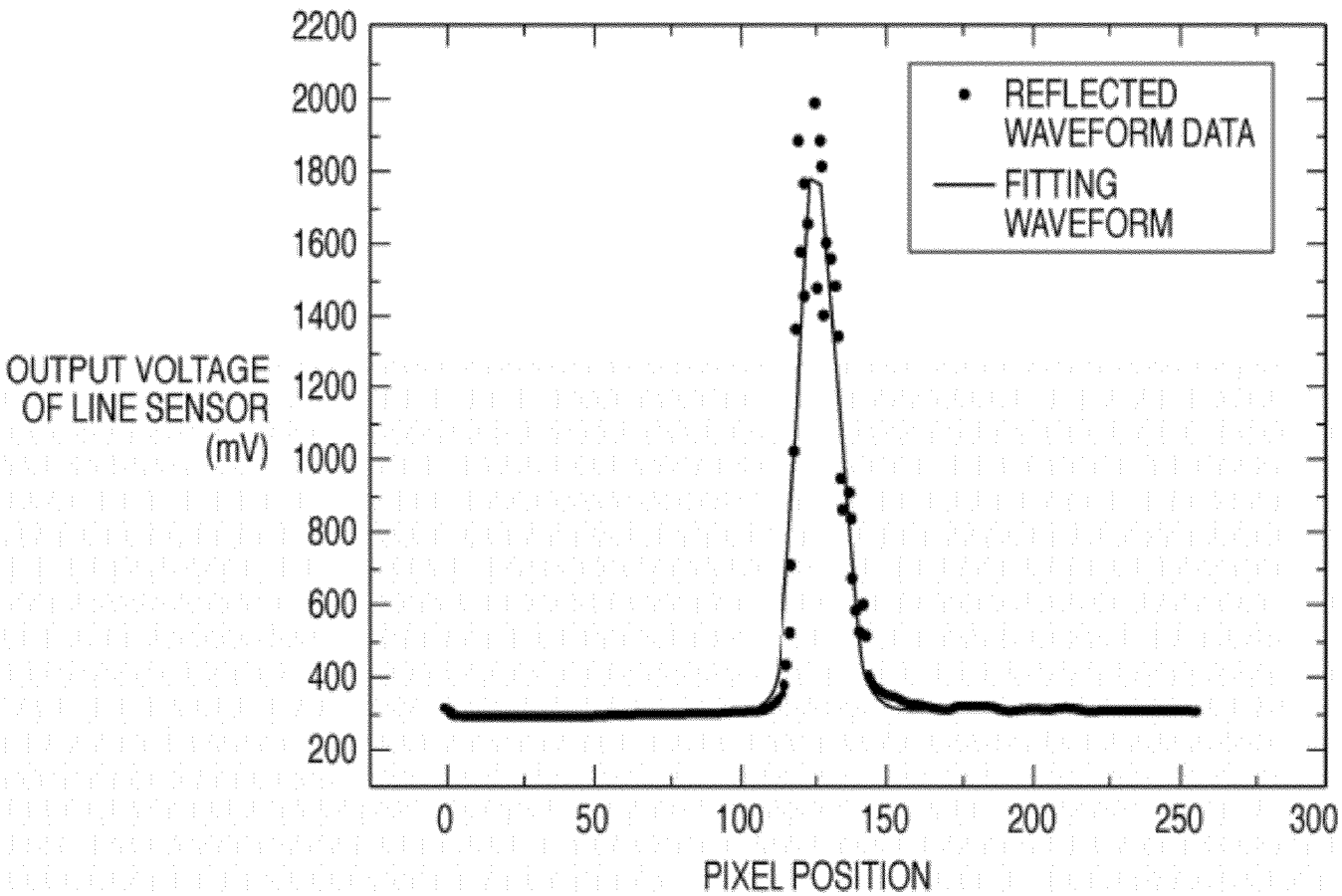
FIG. 12 is a graph for explaining curve fitting based on a Gaussian function.

FIG. 12 is a graph for explaining curve fitting based on the Gaussian function. As shown in FIG. 12, curve fitting is applied to the reflected waveform data stored in the storage unit 705 based on the Gaussian function, thus obtaining feature amounts that represent the shape of the reflected waveform (parameters of the Gaussian function). That is, the parameter μ specifies the peak position, and the parameter A specifies the peak height.

In place of the Gaussian function, curve fitting may be applied using a Lorenz function given by:

$$f(x)=(2A/\pi)\cdot w/\{4(x-x_c)^2+w^2\}+C \quad (5)$$

or using a quadratic function given by:

$$f(x)=A(x-B)^2+C \quad (6)$$

Or without any curve fitting, a pixel position where the reflected waveform data exhibits a maximum value may be specified as the peak position, and that maximum value may be specified as the peak height.

An applied amount arithmetic unit (calculating unit) 905 calculates a toner amount based on the mean value of the position differences stored in the position difference storage unit 902 and/or the mean value of peak height differences stored in the light amount difference storage unit 904, and density information 908 of a toner image to be formed. At this time, the density information 908 of the toner image to be formed is information associated with whether the toner image to be formed is a high- or low-density image. The applied amount arithmetic unit 905 calculates a toner amount based on the mean value of the position differences stored in the position difference storage unit 902 and/or the mean value of the peak height differences stored in the light amount difference storage unit 904 based on a toner amount conversion table held in a memory (not shown). Then, the unit 905 calculates an amount of applied toner. Details of this processing will be described later.

[Toner Patch]

Figure 13:
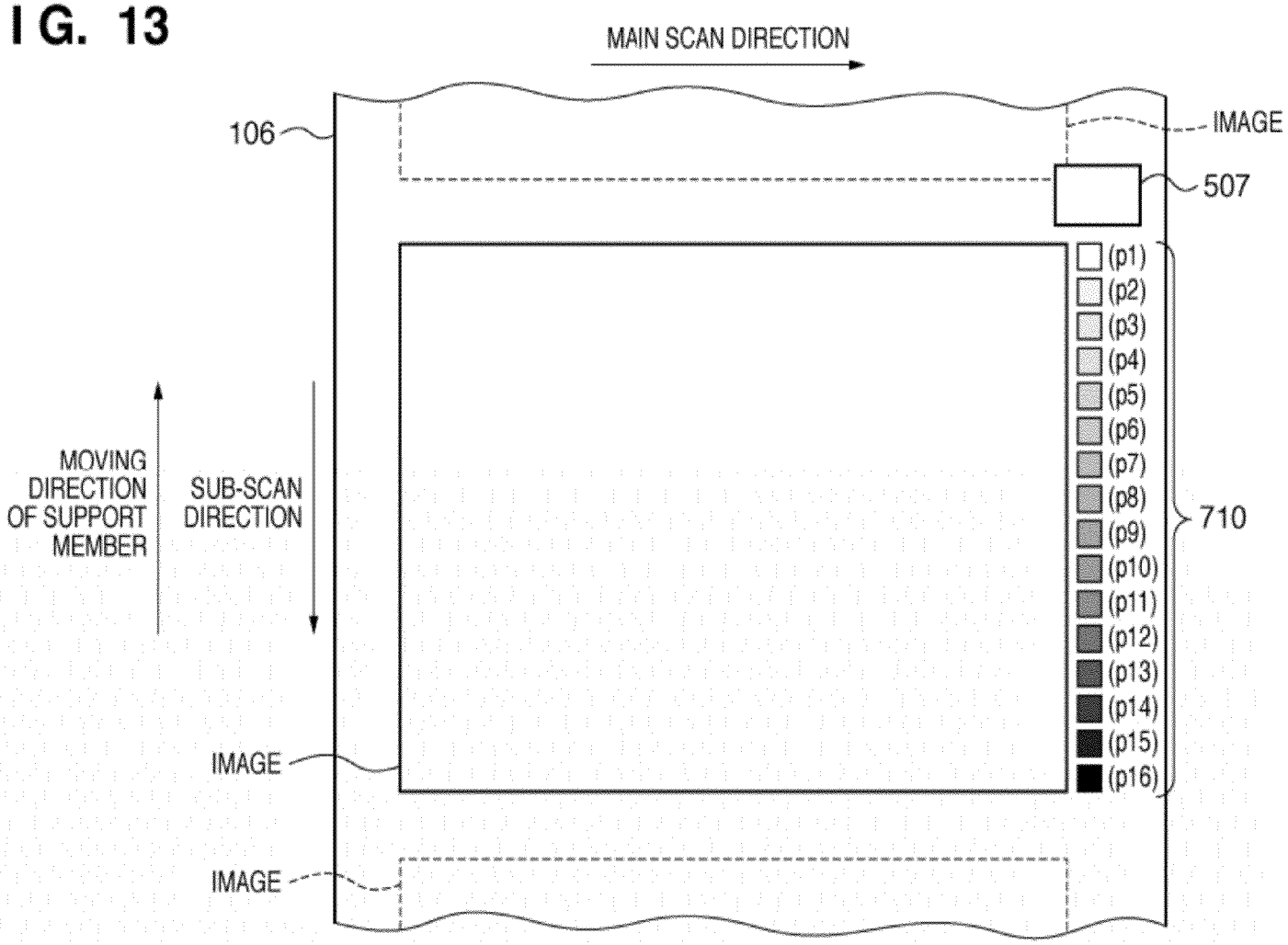
FIG. 13 is a view showing an example of a patch pattern formed on a support member.

FIG. 13 is a view showing an example of a patch pattern formed on the support member 106.

A toner image corresponding to an image to be transferred onto a print sheet is formed on an image region of the support member 106. Furthermore, a patch pattern 710 is intermittently formed in the sub-scan direction on a non-image region of the support member 106 in accordance with a signal from a pattern generator (not shown). As shown in FIG. 13, the patch pattern 710 is formed on the non-image region outside the image region in the main scan direction.

The patch pattern 710 includes the toner patches 105 for 16 grayscale levels, each of which has a size of 10×10 mm. The number of toner patches 105 corresponds to 16 grayscale levels (tonal values=16, 32, . . . , 240, 255) obtained by equally dividing 256 grayscale levels. In the following description, the toner patches 105 may also be expressed by p1, p2, . . . , p16. Note that the number of toner patches 105 can be set to be an arbitrary value.

The amounts of applied toner of the respective toner patches 105 formed on the non-image region of the support member 106 are sequentially measured by the toner amount measuring unit 507 along with rotation or movement of the support member 106.

Assume that the pitch of the photoreceptors in the line sensor 704 of the toner amount measuring unit 507 is set to be equal to or smaller than a product of the optical magnification of the light-receiving lens 703 and the mean particle diameter of toner in consideration of the laminated state of toner.

FIGS. 14A to 14D are views illustrating the laminated state of toner. FIG. 14A shows a state in which no toner is applied, and the surface of the support member 106 is detected in this state. FIG. 14B shows a state in which one layer of toner is applied, and FIG. 14C shows a state in which two layers of toner are laminated. Furthermore, a toner particle may be laminated between toner particles, as shown in FIG. 14D, and the pitch of the photoreceptors is required to also detect the state shown in FIG. 14D.

An optical system of the present invention has the following relationship.

$$h=N\cdot p/M \tag{7}$$

$$L=N\cdot p=M\cdot h \tag{8}$$

where h is the height (μm) of an object,

L is a moving amount (μm) from a reference position on the line sensor, p is an inter-pitch distance (μm/pixel) between neighboring line sensor pixels, M is the optical magnification of the lens, and N is the number of moving pixels from the reference position on the line sensor.

In order to surely discriminate one toner particle, $N \geqq 1$ is desirable. Therefore, it is required to meet the relationship $p \leqq M\cdot h$. Assume that the mean particle diameter of toner is specified by a number mean diameter since an object to be measured is a physical outer size of toner.

In FIGS. 14A to 14C, only one pixel irradiated with light need only be detected. However, in case of FIG. 14D, a peak position is detected by a position detection algorithm (the aforementioned fitting) for "comparing voltages (∝ light intensities) generated by two neighboring pixels irradiated with light".

FIGS. 15A to 15F are views showing an example of sectional profiles of the patch pattern 710.

Figures 15A, 15B, 15C, 15D, 15E, 15F:
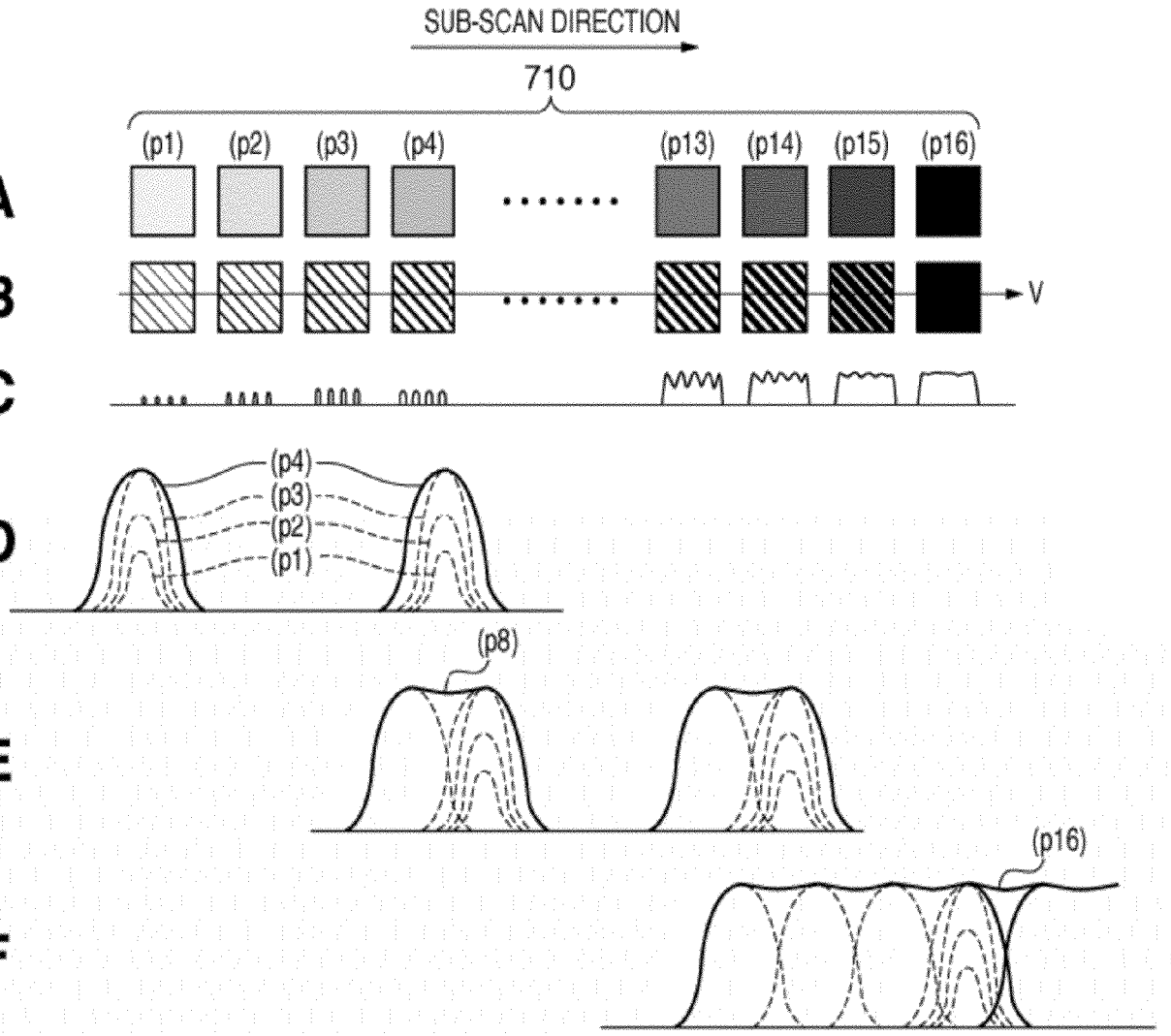
FIGS. 15A to 15F are views showing an example of sectional profiles of the patch pattern.

FIG. 15A corresponds to magenta image information output from the pattern generator. FIG. 15B corresponds to the patch pattern 710 which undergoes screen processing of, for example, 212 lpi (lines/inch) at −45° with respect to the moving direction of the support member 106 and is formed on the support member 106. The toner amount measuring unit 507 measures the amounts of applied toner of the respective toner patches 105 along an arrow V shown in FIG. 15B.

FIG. 15C is a view showing the sections of the respective toner patches 105. For example, in a highlight range (low density range) defined by tonal values from 0 to 48, the height of the section of dots which form each toner patch 105 is increased and the width is also expanded by pulse-width modulation (PWM) in the main scan direction (see FIG. 15D).

Next, in a middle density range defined by tonal values from 48 to 192, dots which form each toner patch 105 overlaps neighboring dots, and the dot section is expanded (see FIG. 15E). Until the middle density range, the section of each toner patch 105 is formed by dots and the exposed portion of the surface of the support member 106.

Furthermore, at high densities, for example, in a high density range defined by tonal values from 192 to 255, the exposed portion of the surface of the support member 106 disappears, and the sections of the toner patches 105 are formed by overlapping dots (see FIG. 15F).

Note that the sections of the toner patches 105 for other color components are similarly expanded according to tonal values as in magenta. Note that the screen processing to be applied to respective color components is different like that, for example, 168 lpi and 63° for yellow, 212 lpi and 45° for cyan, and 200 lpi and 0° for black.

Figure 16A:
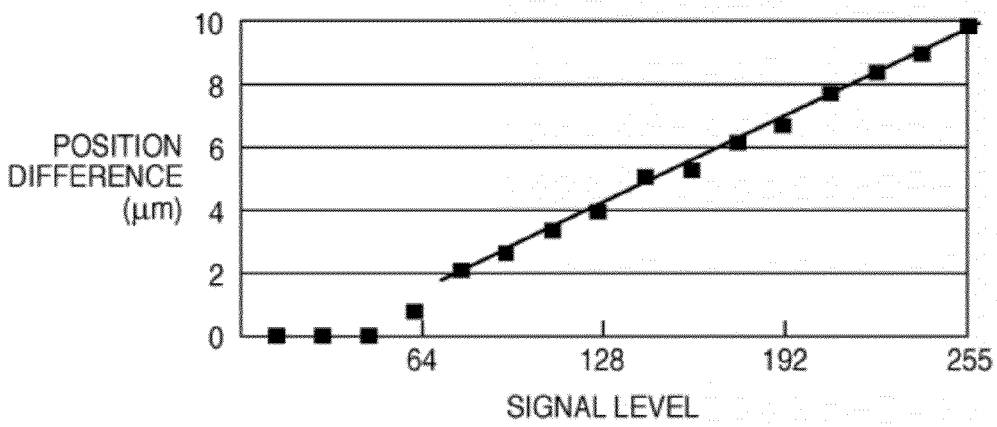
FIGS. 16A and 16B are graphs showing examples of the measurement results of the patch pattern.
Figure 16B:
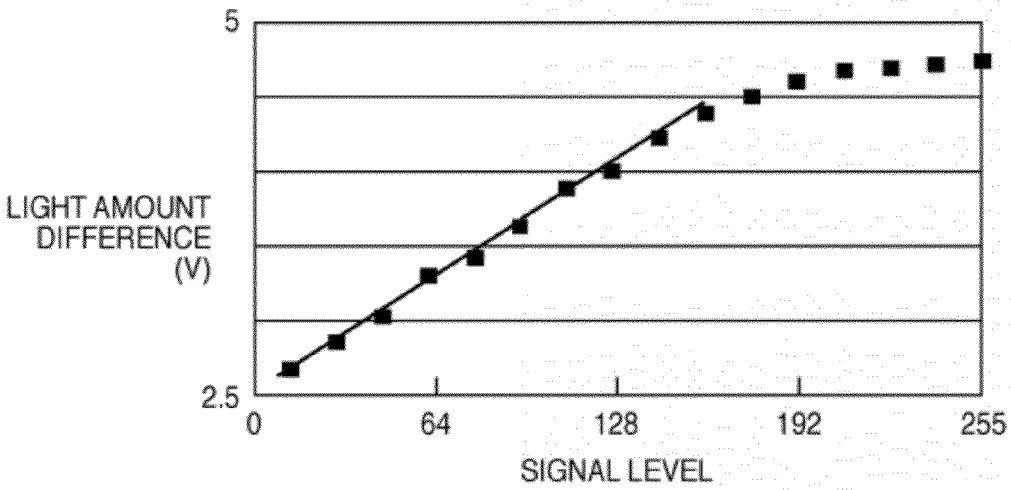

FIGS. 16A and 16B are graphs showing examples of the measurement results of the patch pattern 710. FIG. 16A shows the position difference, and FIG. 16B shows the light amount difference.

As shown in FIG. 15C, the area of a dot that forms each toner patch 105 in the highlight range is smaller than that of the exposed portion (to be referred to as an exposed area hereinafter) of the surface of the support member 106. For this reason, a change in position difference obtained by measuring the toner patch 105 in the highlight range is small. As a result, the linearity of the position difference is decreased in the highlight range, as shown in FIG. 16A.

On the other hand, in the high density range, a change in position difference can be obtained with high precision by measuring the toner patch 105, but a change in amount of reflected light from the toner patch 105 is decreased. For this reason, a change in light amount difference obtained by measuring the toner patch 105 in the high density range is small. As a result, the linearity of the light amount difference is decreased in the high density range, as shown in FIG. 16B.

Figure 17A:
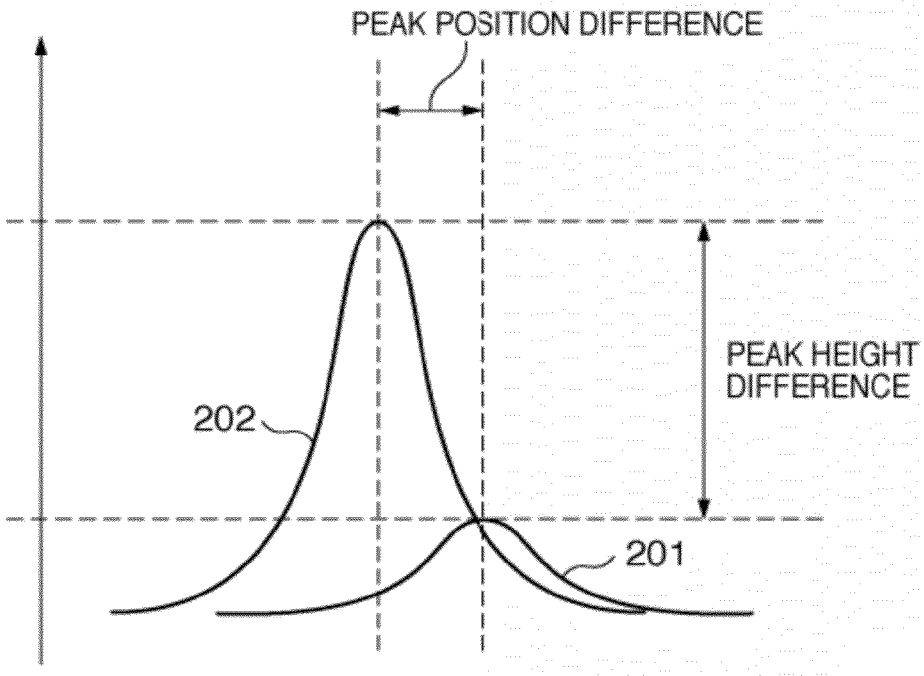
FIGS. 17A and 17B are graphs for explaining reflected waveforms output from an A/D converter of the toner amount measuring unit.
Figure 17B:
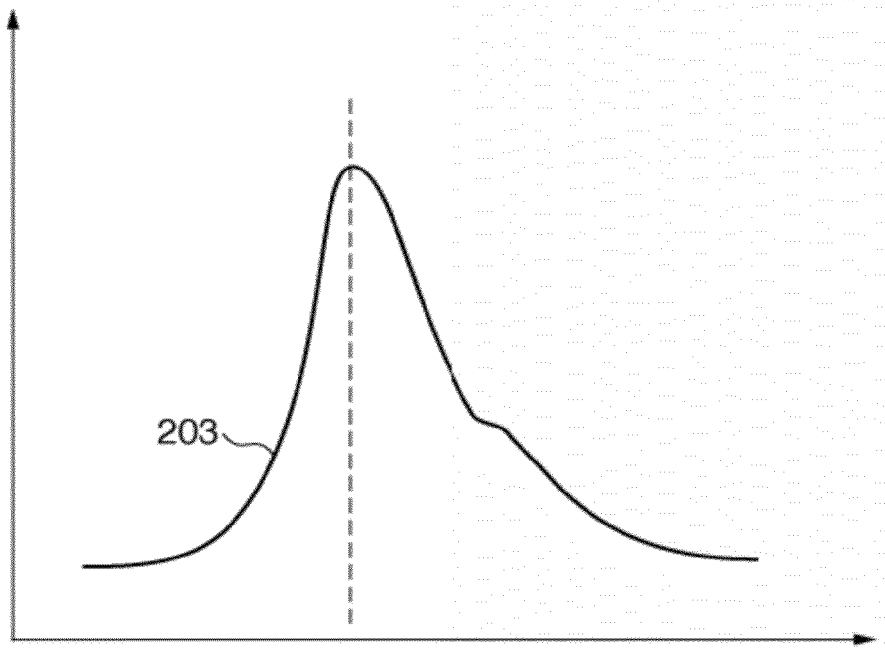

FIGS. 17A and 17B are graphs for explaining reflected waveforms output from the A/D converter 707 of the toner amount measuring unit 507.

The toner amount measuring unit 507 measures a toner reflected waveform 201 from dots that form each toner patch 105 and a support member reflected waveform 202 from the exposed portion of the surface of the support member 106 between dots, as shown in FIG. 17A. Therefore, the reflected waveform output from the A/D converter 707 is a composite waveform 203 of the toner reflected waveform 201 and the support member reflected waveform 202, as shown in FIG. 17B.

That is, since the density becomes higher with increasing forming density (recording density) of toner dots, the occupation ratio of the support member reflected waveform 202 is decreased. As a result, the measurement precision of the light amount difference in the highlight range is improved, while the measurement precision of the light amount difference from the middle density range to the high density range is decreased. Therefore, a detection method for mainly detecting the light amount difference when the recording density is low, and that for mainly detecting the position difference when the recording density is high are preferably used.

[Applied Amount Arithmetic Unit]

Figure 18:
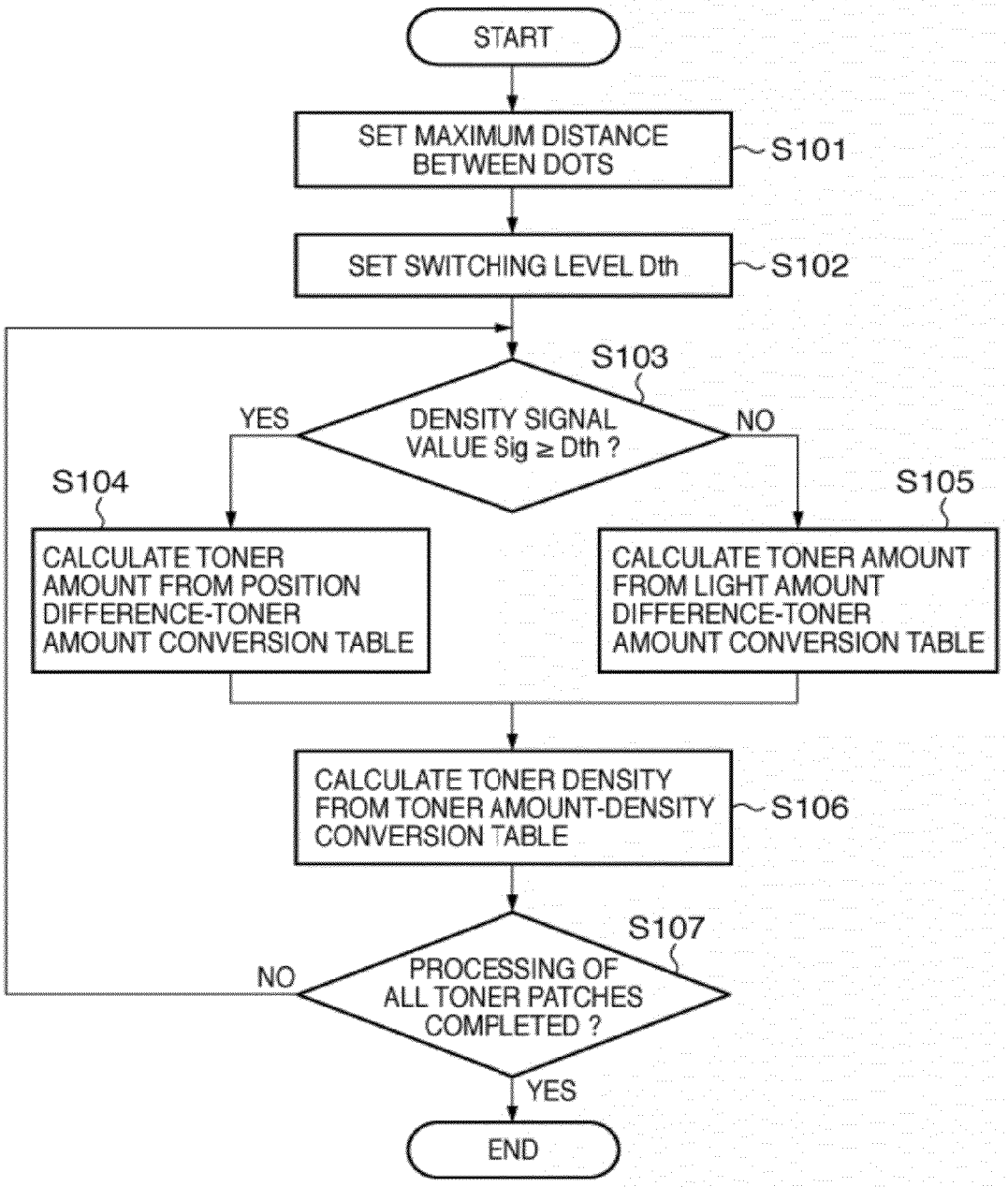
FIG. 18 is a flowchart for explaining an arithmetic operation of the amount of applied toner by an applied amount arithmetic unit.

FIG. 18 is a flowchart for explaining the arithmetic operation of the amount of applied toner by the applied amount arithmetic unit 905.

The applied amount arithmetic unit 905 sets maximum distances (or frequencies) between dots which form the toner patch 105 to be measured for each color component based on the screen ruling value and angle of the toner patch 105 which has undergone the same image forming processing as a toner image on the image region (S101).

Figure 19:
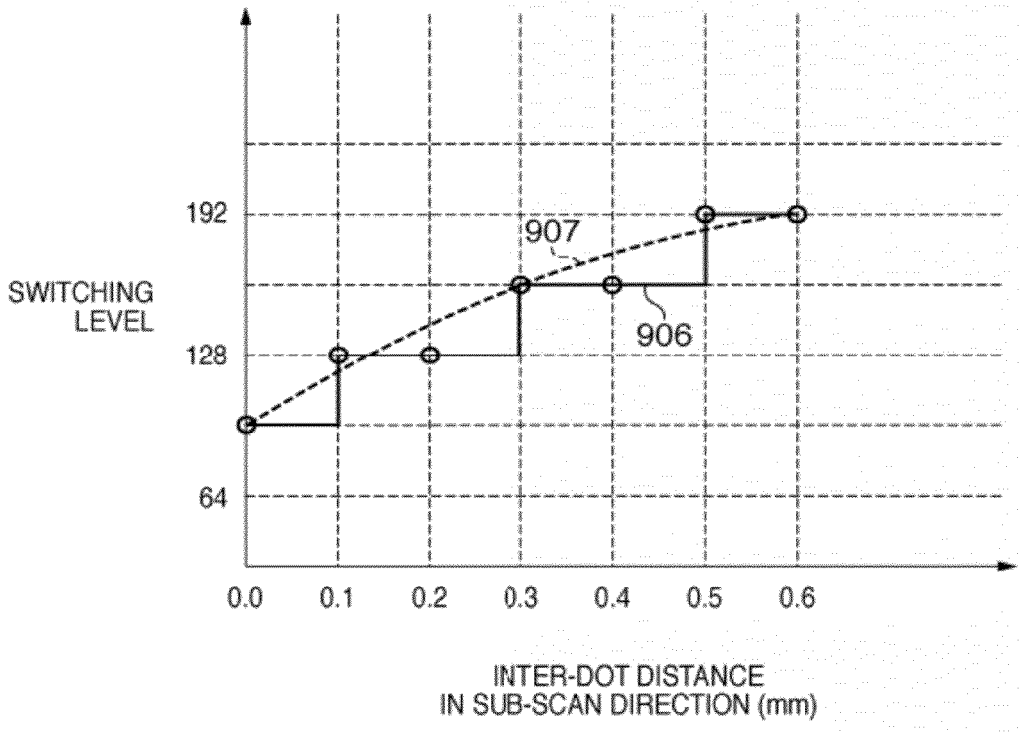
FIG. 19 is a graph showing a switching level of detection methods with respect to a maximum distance between dots determined by a resolution (a screen ruling value and angle).

FIG. 19 is a graph showing the switching level of the detection methods of an image signal with respect to the maximum distance between dots determined by the resolution (the screen ruling value and angle). In FIG. 19, in a region in which the switching level is higher than a solid line 906 or broken curve 907, the position difference is detected. Also, in a region in which the switching level is lower than the solid line 906 or broken curve 907, the light amount difference is detected. Note that the maximum distance between dots corresponds to an inter-dot distance between screen lines in the sub-scan direction.

The applied amount arithmetic unit 905 sets switching levels Dth with respect to the maximum distances set in step S101 for respective colors in accordance with the switching table shown in FIG. 19 (S102). Note that the switching level may be set to change stepwise like Dth=128 for 0.3<X≦0.5 mm (see the solid line 906), or it may be set to change continuously (see the broken curve 907). Note that in case of magenta to which screen processing having −45° and 212 lpi is to be applied, X=0.17 mm and Dth=128.

As described above, the maximum distance between dots and the density signal value Sig are given depending on the toner patch to be formed. Therefore, whether to use the position difference or light amount difference can be switched using the switching table shown in FIG. 19.

Figure 20:
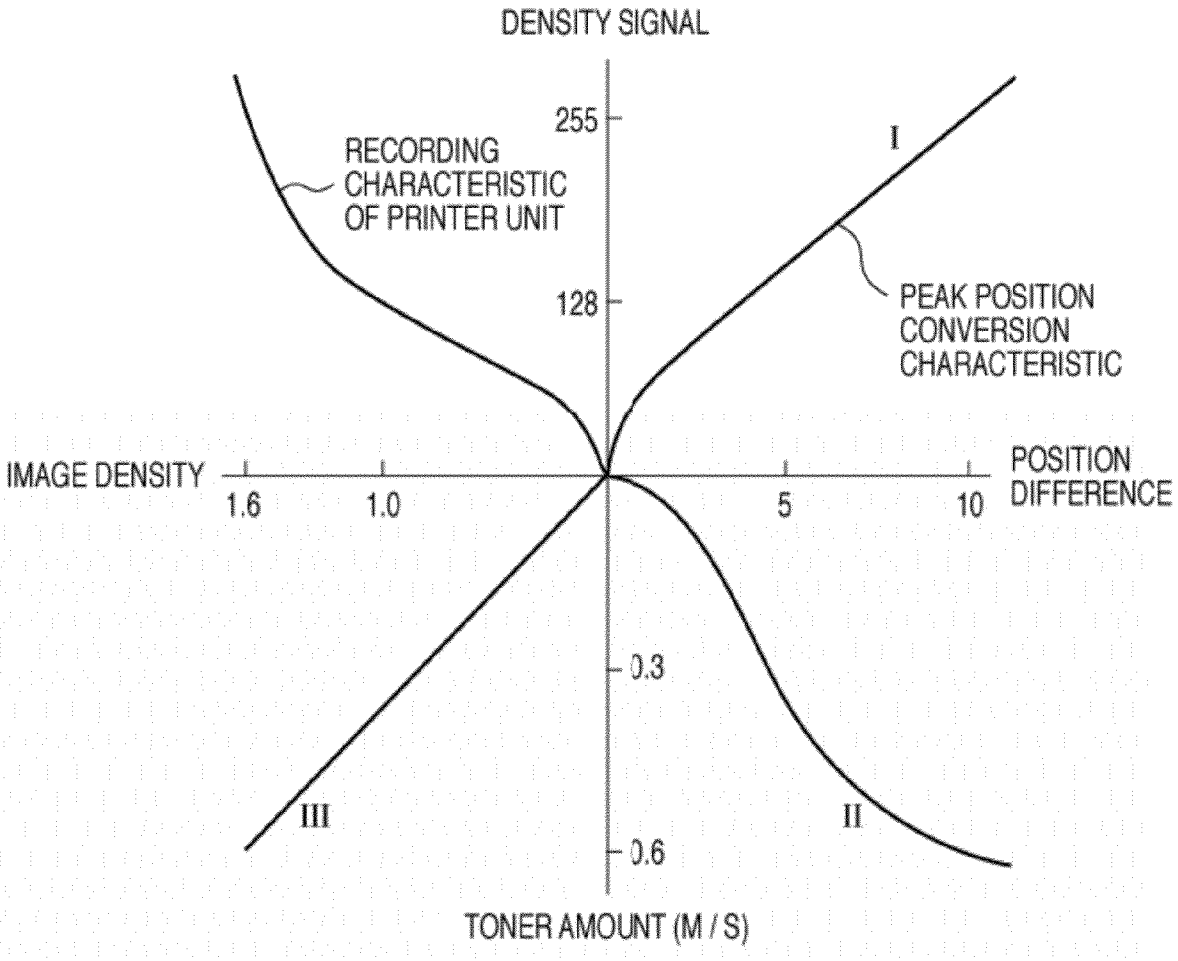
FIG. 20 is a position difference—toner amount conversion table showing an example of the relationship between the density signal value and position difference.
Figure 21:
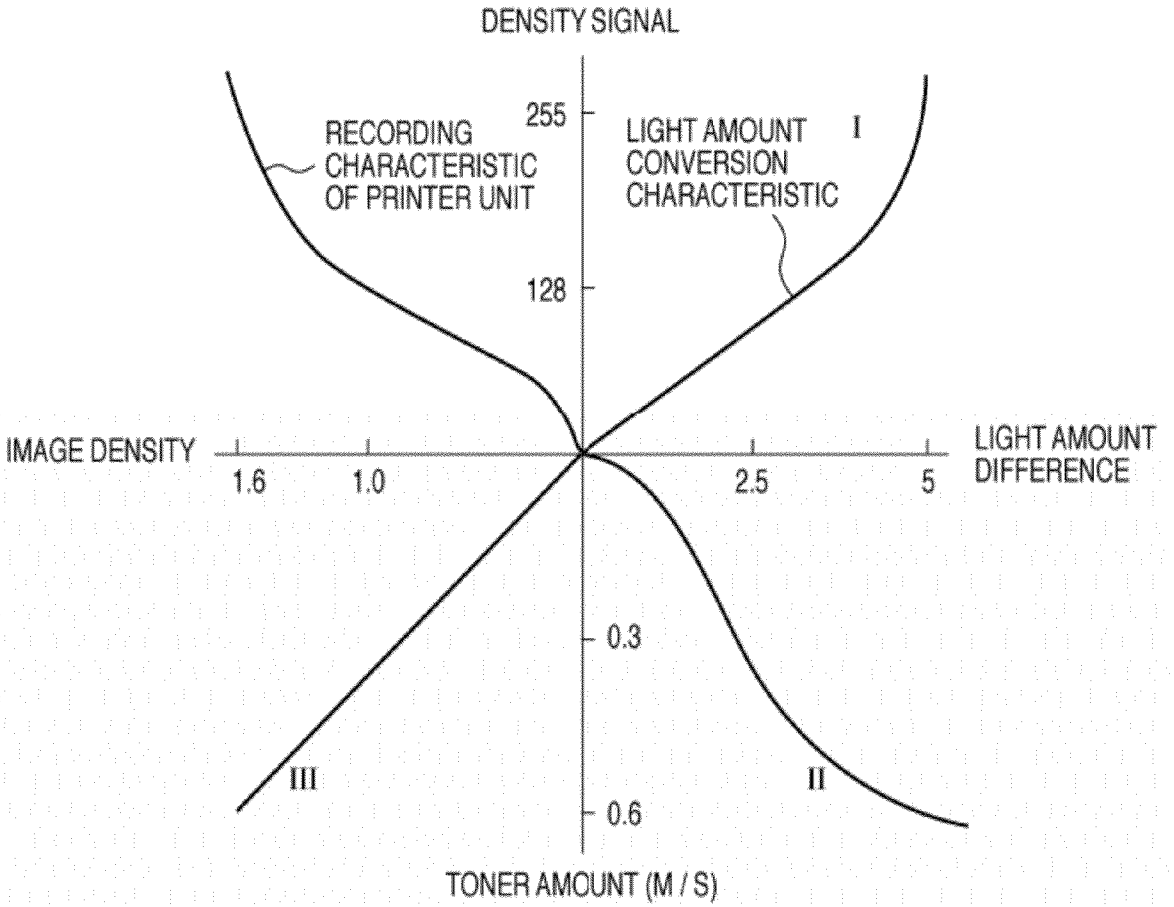
FIG. 21 is a light amount difference—toner amount conversion table showing an example of the relationship between the density signal value and light amount difference.

FIG. 20 is a position difference—toner amount conversion table showing an example of the relationship between the density signal value Sig and position difference. The first quadrant shows the relationship between the density signal value Sig and position difference, and the second quadrant shows the relationship between the position difference and toner amount. FIG. 21 is a light amount difference—toner amount conversion table showing an example of the relationship between the density signal value Sig and light amount difference. The first quadrant shows the relationship between the density signal value Sig and light amount difference, and the second quadrant shows the relationship between the light amount difference and toner amount.

Next, the applied amount arithmetic unit 905 compares the density signal value Sig of the toner patch 105 to be measured with the switching level Dth (S103). If Sig≧Dth, the applied amount arithmetic unit 905 calculates a toner amount M/S per unit area using the relationship between the position difference and toner amount shown in the second quadrant of FIG. 20 (S104). On the other hand, if Sig<Dth, the applied amount arithmetic unit 905 calculates a toner amount M/S per unit area using the relationship between the light amount difference and toner amount shown in the second quadrant of FIG. 21 (S105).

The applied amount arithmetic unit 905 then calculates a toner density using the relationship between the toner amount and image density shown in the third quadrant of the position difference—toner amount conversion table shown in FIG. 20 (S106). Note that the relationship between the toner amount and image density shown in the third quadrant of FIG. 20 is the same as that shown in FIG. 21.

The applied amount arithmetic unit 905 repeats the processes from step S103 to step S106 for the measurement results of all the toner patches 105 included in the patch pattern 710 based on a determination result in step S107. As a result, the recording characteristic of the printer unit of the image forming apparatus, which is the same as the relationship between the density signal value and image density shown in the fourth quadrant of FIG. 20, can be acquired.

[Control Unit]

Figure 22A:
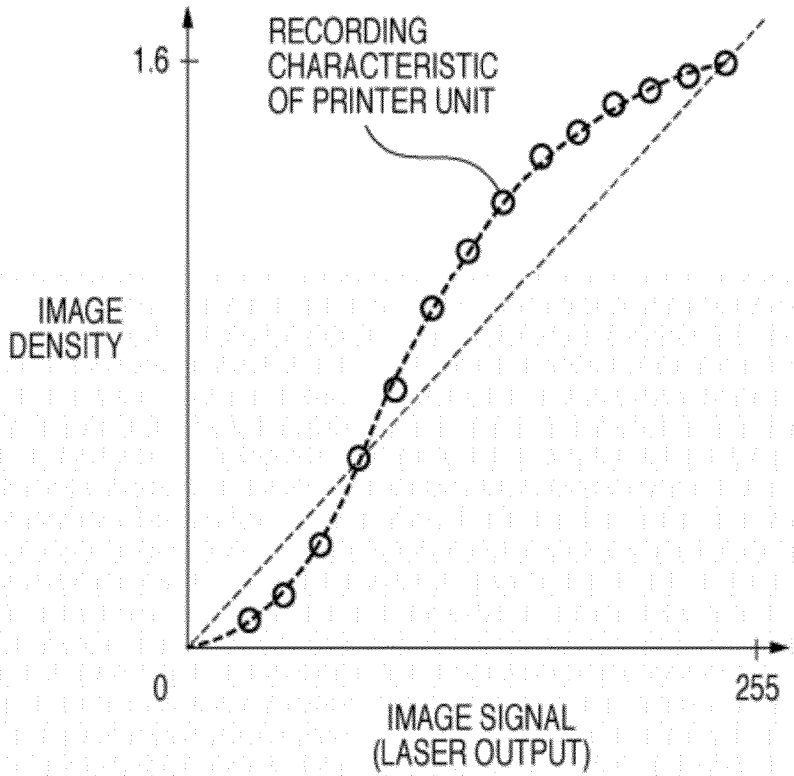
FIGS. 22A and 22B are graphs showing an example of the recording characteristic of a printer unit and a tone correction table.
Figure 22B:
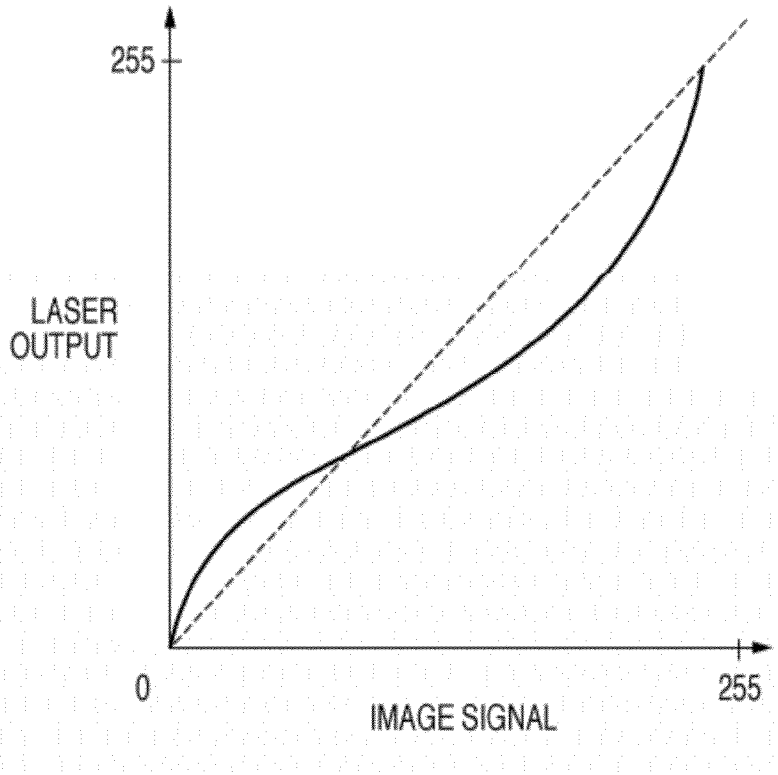

FIGS. 22A and 22B are graphs showing an example of the recording characteristic of the printer unit and a tone correction table.

As described above, the density calculating unit 606 of the control unit 500 calculates density data shown in FIG. 22A (the recording characteristic of the printer unit) from the measured amount of applied toner. Therefore, the controller 607 of the control unit 500 creates a tone correction table (γLUT 609) shown in FIG. 22B which corrects the recording characteristic of the printer unit shown in FIG. 22A (the output characteristic of the image forming apparatus) to be linear. Note that the controller 607 applies smoothing processing or the like to the γLUT 609 so as to prevent reversal of a decrease in laser output with respect to an increase in image signal value. The control unit 500 executes image forming processing after the created γLUT 609 is set.

In this way, the toner amount can be detected with high precision by switching whether to use the thickness of the toner layer (position difference) or the amount of reflected light (light amount difference) in toner amount detection according to the resolution. Also, variations of the printer unit can be detected in real time, and the detected variations are fed back to the next image formation, thus always forming a stable tonal image.

In the above description, an image that has undergone the screen processing has been exemplified. Also, the same effects can be obtained for an image that has undergone dot-pattern processing.

The γLUT 609 need not be fully rewritten, but differences obtained upon detection of the toner amount in a γLUT registered as an initial value or that registered by calibration control or the like may be rewritten.

Second Embodiment

Tone correction according to the second embodiment of the present invention will be described below. Note that the same reference numerals in the second embodiment denote the same components as in the first embodiment, and a detailed description thereof will not be repeated.

In the first embodiment, whether the amount of applied toner is calculated from the position difference or light amount difference is switched based on the switching level shown in FIG. 19, which can be set in advance. The second embodiment will describe an example in which a dynamic switching level according to a difference between the amounts of reflected light of the support member 106 and toner patch 105 (light amount difference) is used.

When the amount of reflected light from each toner patch 105 is small, the precision of curve fitting deteriorates, and it is difficult to accurately detect the peak position of the reflected waveform from the toner patch. In other words, the precision of the position difference of the toner patch 105 having a large light amount difference Id is low. Therefore, the switching level used in the arithmetic operation of the amount of applied toner is desirably determined in consideration of the light amount difference.

Figure 23:
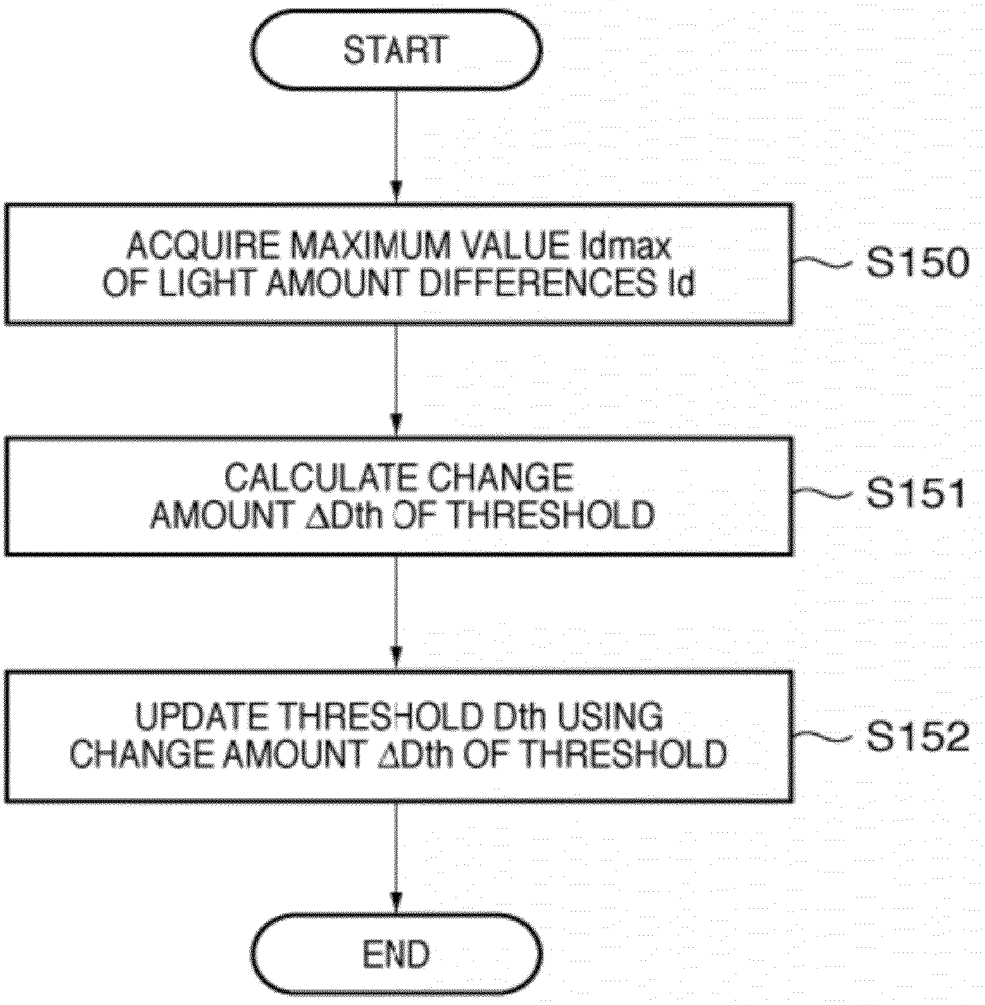
FIG. 23 is a flowchart for explaining switching level determination processing by an attached amount arithmetic unit according to the second embodiment.

FIG. 23 is a flowchart for explaining the switching level determination processing by the applied amount arithmetic unit 905 according to the second embodiment.

Figure 26:
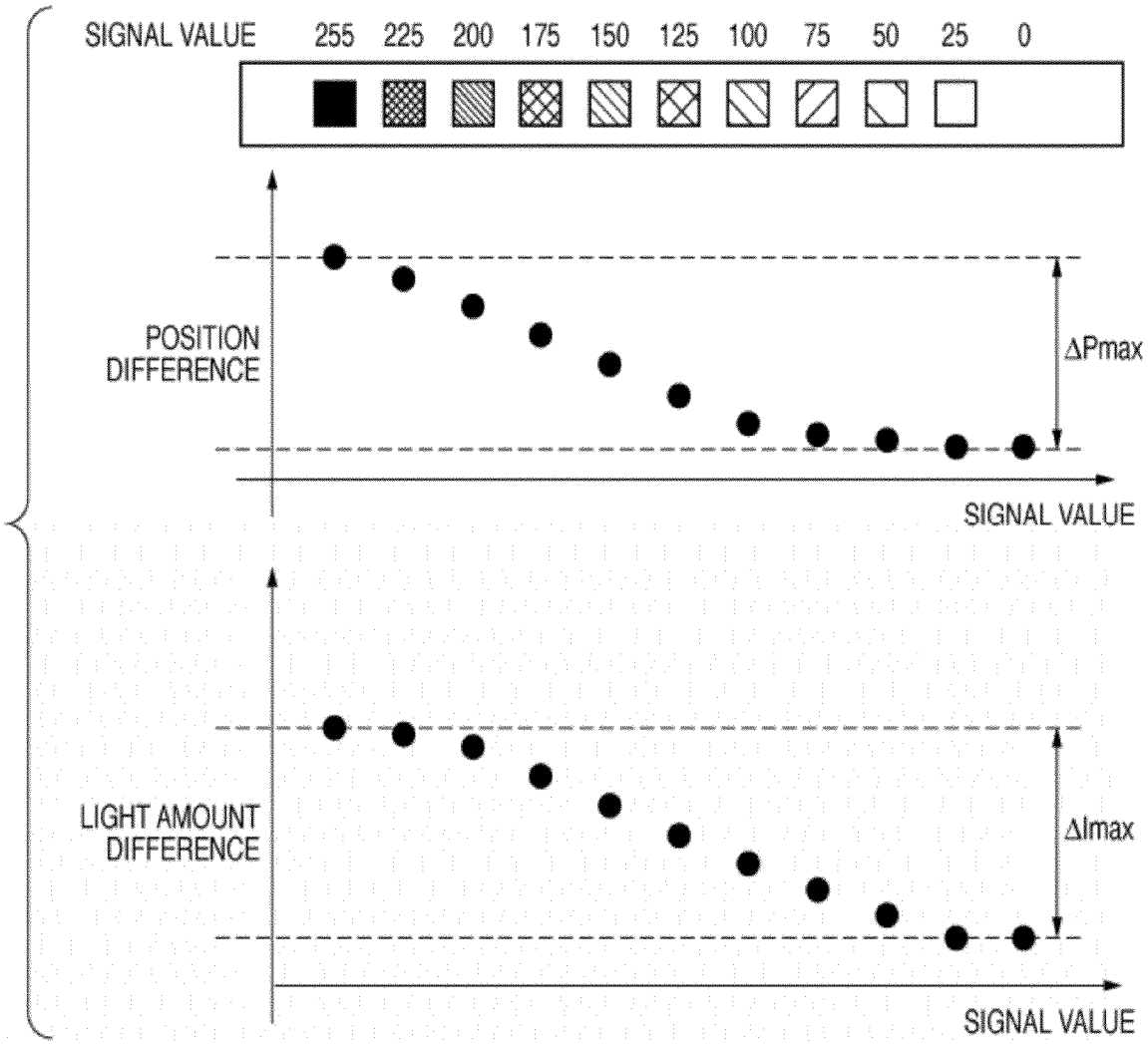
FIG. 26 is a view for explaining a maximum position difference $\Delta P_{max}$ and maximum light amount change $\Delta I_{max}$.

The applied amount arithmetic unit 905 acquires a maximum value Idmax of the light amount differences Id by checking data in the light amount difference storage unit 904 (S150). A maximum light amount change ΔImax indicates a maximum difference of the light amounts of a plurality of reflected waveform data obtained from a plurality of toner images formed to have different densities, as shown in FIG. 26. In FIG. 26, ΔImax is calculated from the light amount differences (peak heights) of a plurality of reflected waveform data obtained from toner images having different densities, that is, density signal values ranging from 0 to 255. A change amount ΔDth of a threshold is then calculated by (S151):

$$\Delta Dth = B \times (Id\max - Idth) \tag{9}$$

where B is a coefficient (predetermined value), and

Idth is a threshold (predetermined value) of the light amount difference.

Equation (9) compares the maximum value Idmax of the light amount differences with the predetermined threshold Idth of the light amount difference. If Idmax<Idth, it is determined that the amount of reflected light from the toner patch 105 is small and the precision of the position difference is low, and a change amount ΔDth<0 of the threshold used to change the threshold Dth in a direction to decrease is calculated. If Idmax≧Idth, it is determined that the amount of reflected light from the toner patch 105 is sufficient and the precision of the position difference is high, and a change amount ΔDth≧0 of the threshold used to change the threshold Dth in a direction to increase is calculated.

The applied amount arithmetic unit 905 updates the threshold Dth using the change amount ΔDth of the threshold (S152).

$$Dth=Dth+\Delta Dth \tag{10}$$

After that, the applied amount arithmetic unit 905 executes an arithmetic operation of the amount of applied toner shown in FIG. 18 using the threshold Dth calculated using equation (10).

As described above, since the switching level in the arithmetic operation of the amount of applied toner is dynamically set in consideration of the light amount difference Id, the measurement result of the amount of applied toner can be obtained with higher precision. Note that control for switching Dth by measuring a peak difference can be executed in the same manner as that measures the light amount difference.

Third Embodiment

Tone correction according to the third embodiment of the present invention will be described below. Note that the same reference numerals in the third embodiment denote the same components as in the first and second embodiments, and a detailed description thereof will not be repeated.

The first and second embodiments have explained the example in which the position difference and light amount difference are switched as data used in the arithmetic operation of the amount of applied toner using the switching level. The third embodiment will explain an example in which the amount of applied toner is calculated using all position difference and light amount difference data without switching data.

Figure 24:
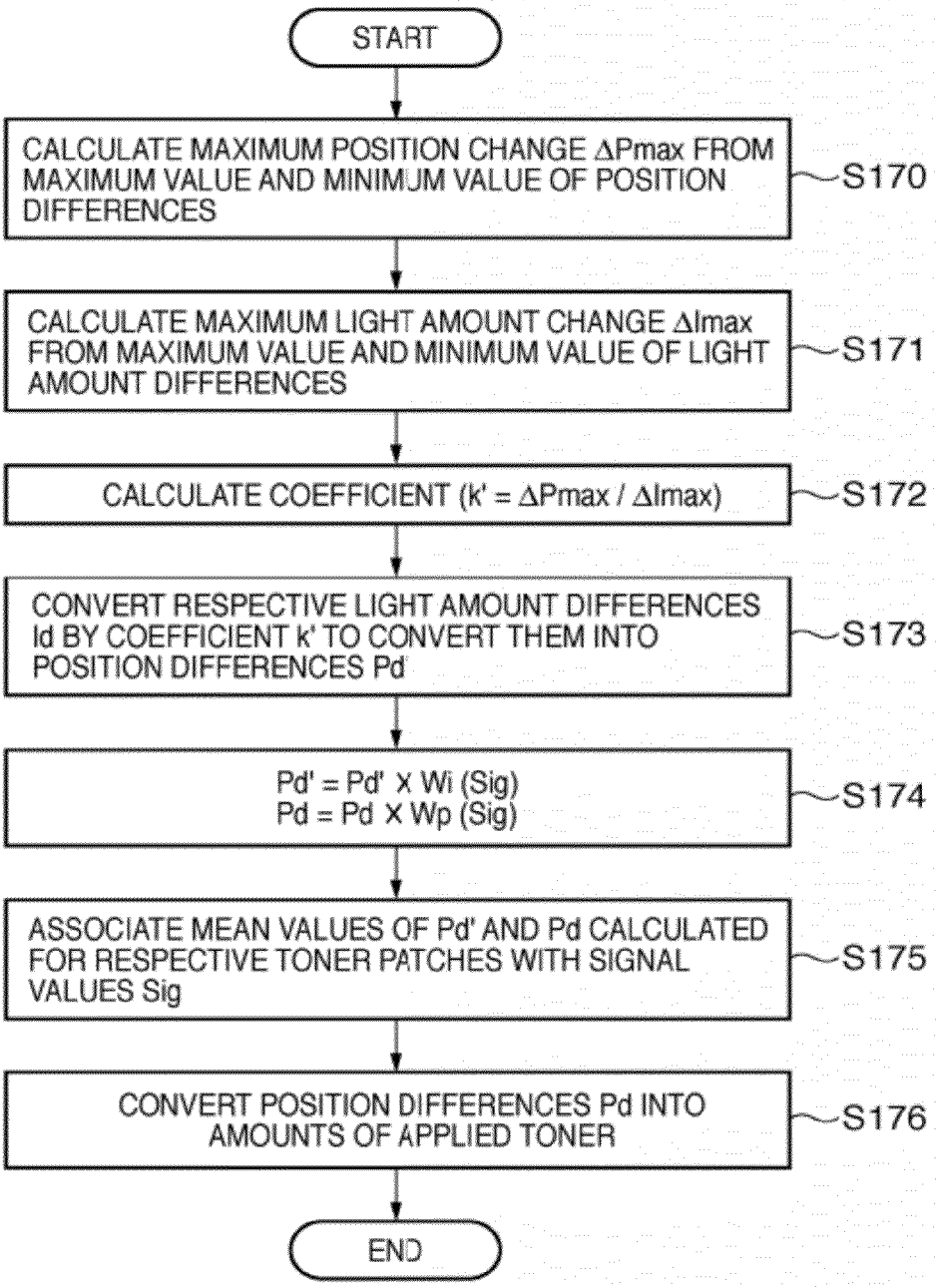
FIG. 24 is a flowchart for explaining an arithmetic operation of the amount of applied toner by an attached amount arithmetic unit according to the third embodiment.

FIG. 24 is a flowchart for explaining the arithmetic operation of the amount of applied toner by the applied amount arithmetic unit 905 according to the third embodiment.

The applied amount arithmetic unit 905 changes contribution ratios of position differences Pd and light amount differences Id with respect to the arithmetic operation of the amount of applied toner using weights Wp(Sig) and Wi(Sig) according to a density signal value Sig. Then, the unit 905 uses the mean values of the position differences and light amount differences after weighting corresponding to the respective toner patches 105 in the arithmetic operation of the amount of applied toner.

However, since the position difference Pd and light amount difference Id have different units, data that represents the amount of applied toner cannot be obtained by simply arranging the position difference Pd and light amount difference Id. In order to adjust the units of the position difference Pd and light amount difference Id, the applied amount arithmetic unit 905 calculates a maximum position change ΔPmax from a maximum value and minimum value of the position differences Pd stored in the position difference storage unit 902 (S170). The maximum position difference ΔPmax indicates a maximum difference of the peak positions of a plurality of reflected waveform data, which are obtained from a plurality of toner images formed to have different densities, as shown in FIG. 26. In FIG. 26, ΔPmax is calculated from the peak positions of the plurality of reflected waveforms obtained from toner images having different densities, that is, density signal values ranging from 0 to 255.

The applied amount arithmetic unit 905 calculates a maximum light amount change ΔImax from a maximum value and minimum value of the light amount differences Id stored in the light amount difference storage unit 904 (S171). The maximum light amount change ΔImax indicates a maximum difference of the light amounts of a plurality of reflected waveform data obtained from a plurality of toner images formed to have different densities, as shown in FIG. 26. In FIG. 26, ΔImax is calculated from the light amount differences (peak heights) of a plurality of reflected waveform data obtained from toner images having different densities, that is, density signal values ranging from 0 to 255.

Then, the applied amount arithmetic unit 905 calculates ΔPmax/ΔImax as a coefficient k' used to adjust the units (S172), and multiplies the respective light amount differences Id stored in the light amount storage unit 904 by the coefficient k' to convert the light amount differences Id into the position differences Pd (S173).

The applied amount arithmetic unit 905 multiplies position differences Pd' (light amount differences after conversion) stored in the light amount difference storage unit 904 by the weight Wi(Sig) according to the density signal value Sig, which weight is given by:

$$Wi(Sig)=(Sig-255)/255 \tag{11}$$

The applied amount arithmetic unit 905 multiplies the position differences Pd stored in the position difference storage unit 902 by the weight Wp(Sig) according to the density signal value Sig, which weight is given by:

$$Wp(Sig)=Sig/255 \tag{12}$$

In this way, the applied amount arithmetic unit 905 weights data corresponding to respective toner patches (S174).

As described by equation (12), the weight Wp(Sig) is a weight which assumes "1" when the density signal value Sig is "255" (maximum) and "0" when it is "0" (minimum), that is, 0≦Wp(Sig)≦1. Also, as described by equation (11), the weight Wi(Sig) is a weight which assumes "0" when the density signal value Sig is "255" (maximum) and "1" when it is "0" (minimum), that is, 0≦Wi(Sig)≦1. Therefore, the contribution ratio of the position difference Pd with respect to the arithmetic operation of the amount of applied toner becomes high in a high density range, and that of the light amount difference Id becomes high in a low density range.

In the above description, the position differences Pd and light amount differences Id are evenly weighted. However, the present invention is not limited to this, and they may be appropriately weighted according to a pattern of the toner patches 105.

Next, the applied amount arithmetic unit 905 calculates a mean value of the position difference multiplied by the weight, and the light amount difference which is converted into the position difference and is multiplied by the weight for each toner patch, and associates the mean value with the density signal value Sig (S175). Then, the applied amount arithmetic unit 905 multiplies the respective mean values by a coefficient j which is determined based on the geometric arrangement of the toner amount measuring unit 507, thus converting them into amounts of applied toner (unit: μm) (S176).

Modification of Embodiments

Figure 25:
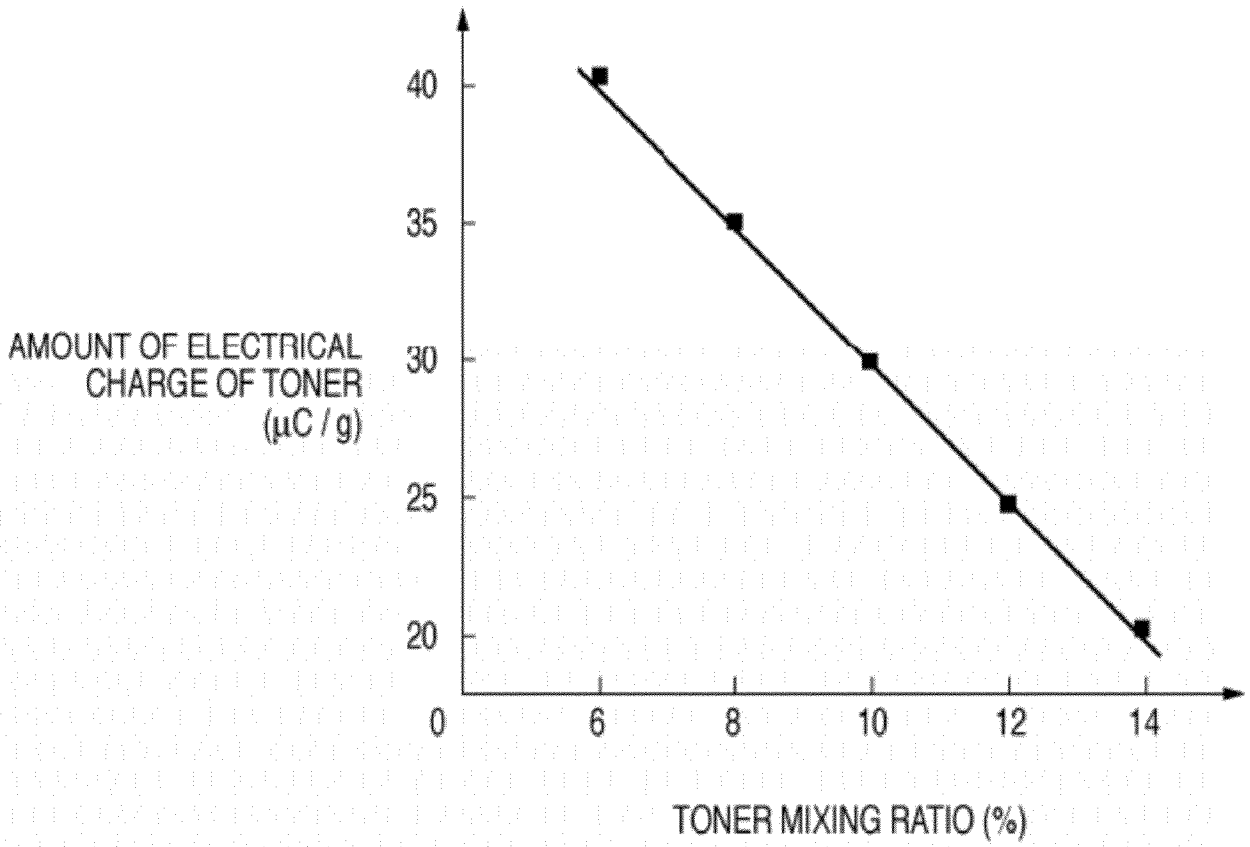
FIG. 25 is a graph showing the relationship between the toner mixing ratio and amount of electrical charge of toner in a specific environment.

FIG. 25 is a graph showing the relationship between the toner mixing ratio and amount of electrical charge of toner in a specific environment.

Since the relationship between the toner mixing ratio and amount of electrical charge of toner changes depending on an environment (temperature, humidity, etc.) where the image forming apparatus is equipped, the image forming apparatus includes an environment sensor for detecting a change in environment. Therefore, toner patches are formed according to the temperature and humidity detected by the environment sensor, and the amounts of electrical charge of toner can be calculated from the measurement results of toner patches by the toner amount measuring unit 507. Then, the toner mixing ratio (a ratio of the toner amount, and toner amount+carrier amount) according to the environmental condition of the image forming apparatus with reference to FIG. 25, thus controlling the toner supply amount. That is, an appropriate toner mixing ratio at that time can be calculated from the amount of electrical charge of toner.

When the toner mixing ratio is higher than the appropriate toner mixing ratio (e.g., 10%), toner supply is stopped; when the toner mixing ratio is lower than the appropriate toner mixing ratio, toner supply is started to attain the appropriate toner mixing ratio.

According to the aforementioned embodiments, the functions of the patch sensor and laser displacement sensor are implemented by a single sensor. Whether an integrated light amount change by the patch sensor function or a toner layer thickness change by the laser displacement sensor function is mainly used in measurement of the amount of applied toner is switched according to the density range, dot pattern, and screen pattern. Therefore, the amount of applied toner can be accurately measured. Also, the patch size can be greatly reduced compared to the conventional size, thus reducing the toner consumption amount. Furthermore, toner patches are formed between neighboring image regions in the conventional method. However, since toner patches are formed on a non-image region that neighbors an image region, the productivity of the image forming apparatus can be prevented from deteriorating. Also, by increasing the number of toner patches, the precision of density correction can be further improved.

As described above, the amount of applied toner is calculated by switching the amount of reflected light and toner height, which are detected by a single sensor, depending on whether or not each toner patch or patch pattern falls with a low density range. Therefore, the color reproducibility and maximum density can be assured without increasing the size and cost of the image processing apparatus. Furthermore, since the semiconductor laser is used as a measurement light source, the toner patch size can be reduced. Therefore, tone correction can be implemented without impairing the productivity of the image forming apparatus, thus reducing the toner consumption amount. Moreover, by increasing the number of toner patches, the precision of tone reproducibility can be further improved.

Exemplary Embodiments

The present invention can be applied to a system constituted by a plurality of devices (e.g., host computer, interface, reader, printer) or to an apparatus comprising a single device (e.g., copying machine, facsimile machine).

Further, the present invention can provide a storage medium storing program code for performing the above-described processes to a computer system or apparatus (e.g., a personal computer), reading the program code, by a CPU or MPU of the computer system or apparatus, from the storage medium, then executing the program.

In this case, the program code read from the storage medium realizes the functions according to the embodiments.

Further, the storage medium, such as a floppy disk, a hard disk, an optical disk, a magneto-optical disk, CD-ROM, CD-R, a magnetic tape, a non-volatile type memory card, and ROM can be used for providing the program code.

Furthermore, besides above-described functions according to the above embodiments can be realized by executing the program code that is read by a computer, the present invention includes a case where an OS (operating system) or the like working on the computer performs a part or entire processes in accordance with designations of the program code and realizes functions according to the above embodiments.

Furthermore, the present invention also includes a case where, after the program code read from the storage medium is written in a function expansion card which is inserted into the computer or in a memory provided in a function expansion unit which is connected to the computer, CPU or the like contained in the function expansion card or unit performs a part or entire process in accordance with designations of the program code and realizes functions of the above embodiments.

In a case where the present invention is applied to the aforementioned storage medium, the storage medium stores program code corresponding to the flowcharts described in the embodiments.

An embodiment of the present invention can provide a measuring apparatus for measuring a toner amount of a toner image formed on an image carrying member of an image forming apparatus, the measuring apparatus comprising: light irradiating means for irradiating the toner image with light; image capturing means for capturing the toner image, wherein the image capturing means has a plurality of photoreceptors arranged adjacent to each other; and calculating means for acquiring information associated with peak positions of reflected waveforms and information associated with peak heights of the reflected waveforms from data obtained by receiving light reflected by the toner image by the plurality of photoreceptors, and for calculating the toner amount based on at least one of the peak position and the peak height and information associated with a density of the toner image to be formed.

In such a measuring apparatus, the calculating means can calculate the toner amount based on the peak position when the density of the toner image to be formed is high, and calculate the toner amount based on the peak height when the density of the toner image to be formed is low.

Preferably, when toner amounts of a plurality of toner images having different densities are to be measured, the calculating means determines a toner image, the toner amount of which is to be calculated based on the peak position, and a toner image, the toner amount of which is to be calculated based on the peak height, of the plurality of toner images having the different densities, in accordance with a difference between a peak height of reflected waveform data of a high-density toner image and a peak height of reflected waveform data of a low-density toner image.

Preferably, when toner amounts of a plurality of toner images having different densities are to be measured, the calculating means determines a toner image, the toner amount of which is to be calculated based on the peak position, and a toner image, the toner amount of which is to be calculated based on the peak height, of the plurality of toner images having the different densities, in accordance with a difference between a peak position of reflected waveform data of a high-density toner image and a peak position of reflected waveform data of a low-density toner image.

Preferably, when the density of the toner image to be formed is low, the calculating means weights the peak height rather than the peak position and calculates the toner amount based on the peak position and the peak height, and when the density of the toner image to be formed is high, the calculating means weights the peak position rather than the peak height, and calculates the toner amount based on the peak position and the peak height.

Another embodiment of the invention can provide, a measuring apparatus for measuring a toner amount of a toner image formed on an image carrying member of an image forming apparatus, the measuring apparatus comprising: light irradiating means for irradiating the toner image with light; image capturing means for capturing the toner image, wherein the image capturing means has a plurality of photoreceptors arranged adjacent to each other; and calculating means for acquiring information associated with peak positions of reflected waveforms and information associated with areas of the reflected waveforms from data obtained by receiving light reflected by the toner image by the plurality of photoreceptors, and for calculating the toner amount based on at least one of the peak position and the area and information associated with a density of the toner image to be formed.

In such an apparatus, the calculating means can calculate the toner amount based on the peak position when the density of the toner image to be formed is high, and calculate the toner amount based on the area when the density of the toner image to be formed is low.

Preferably, when toner amounts of a plurality of toner images having different densities are to be measured, the calculating means determines a toner image, the toner amount of which is to be calculated based on the peak position, and a toner image, the toner amount of which is to be calculated based on the area, of the plurality of toner images having the different densities, in accordance with a difference between an area of reflected waveform data of a high-density toner image and an area of reflected waveform data of a low-density toner image.

Preferably, when toner amounts of a plurality of toner images having different densities are to be measured, the calculating means determines a toner image, the toner amount of which is to be calculated based on the peak position, and a toner image, the toner amount of which is to be calculated based on the area, of the plurality of toner images having the different densities, in accordance with a difference between a peak position of reflected waveform data of a high-density toner image and a peak position of reflected waveform data of a low-density toner image.

Preferably, when the density of the toner image to be formed is low, the calculating means weights the area rather than the peak position and calculates the toner amount based on the peak position and the area, and when the density of the toner image to be formed is high, the calculating means weights the peak position rather than the area, and calculates the toner amount based on the peak position and the area.

Preferably, a pitch of the photoreceptors which are arranged adjacent to each other is not more than a product of an optical magnification of a condensing lens of the image capturing means and a mean particle diameter of toner.

A further embodiment of the invention can provide an image forming apparatus comprising: image forming means for forming a toner image on an image carrying member; and a measuring apparatus which is described in preceding claim.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2008-189046, filed Jul. 22, 2008 and 2009-103360, filed Apr. 21, 2009, which are hereby incorporated by reference herein in their entirety.

What is claimed is:

1. A measuring apparatus for measuring a toner amount of a toner image formed on an image carrying member of an image forming apparatus, the measuring apparatus comprising:

a light irradiating section, configured to irradiate the toner image with light;

an image capturing section, configured to capture the toner image, wherein the image capturing section has a plurality of photoreceptors arranged adjacent to each other; and a calculator, configured to acquire information associated with peak positions of reflected waveforms and information associated with peak heights of the reflected waveforms from data obtained by receiving light reflected by the toner image by the plurality of photoreceptors, and to calculate the toner amount based on:

(i) information associated with a density of the toner image to be formed, and (ii) at least one of: (a) the peak position and (b) the peak height.

2. The apparatus according to claim 1, wherein the calculator calculates the toner amount based on the peak position when the density of the toner image to be formed is high, and calculates the toner amount based on the peak height when the density of the toner image to be formed is low.

3. The apparatus according to claim 1, wherein when toner amounts of a plurality of toner images having different densities are to be measured, the calculator determines a toner image, the toner amount of which is to be calculated based on the peak position, and a toner image, the toner amount of which is to be calculated based on the peak height, of the plurality of toner images having the different densities, in accordance with a difference between a peak height of reflected waveform data of a high-density toner image and a peak height of reflected waveform data of a low-density toner image.

4. The apparatus according to claim 1, wherein when toner amounts of a plurality of toner images having different densities are to be measured, the calculator determines a toner image, the toner amount of which is to be calculated based on the peak position, and a toner image, the toner amount of which is to be calculated based on the peak height, of the plurality of toner images having the different densities, in accordance with a difference between a peak position of reflected waveform data of a high-density toner image and a peak position of reflected waveform data of a low-density toner image.

5. The apparatus according to claim 1, wherein when the density of the toner image to be formed is low, the calculator weights the peak height rather than the peak position and calculates the toner amount based on the peak position and the peak height, and when the density of the toner image to be formed is high, the calculator weights the peak position rather than the peak height, and calculates the toner amount based on the peak position and the peak height.

6. A measuring apparatus for measuring a toner amount of a toner image formed on an image carrying member of an image forming apparatus, the measuring apparatus comprising:

a light irradiating section, configured to irradiate the toner image with light;

an image capturing section, configured to capture the toner image, wherein the image capturing section has a plurality of photoreceptors arranged adjacent to each other; and a calculator, configured to acquire information associated with peak positions of reflected waveforms and information associated with areas of the reflected waveforms from data obtained by receiving light reflected by the toner image by the plurality of photoreceptors, and to calculate the toner amount based on:

(i) information associated with a density of the toner image to be formed, and (ii) at least one of: (a) the peak position and (b) the area.

7. The apparatus according to claim 6, wherein the calculator calculates the toner amount based on the peak position when the density of the toner image to be formed is high, and calculates the toner amount based on the area when the density of the toner image to be formed is low.

8. The apparatus according to claim 6, wherein when toner amounts of a plurality of toner images having different densities are to be measured, the calculator determines a toner image, the toner amount of which is to be calculated based on the peak position, and a toner image, the toner amount of which is to be calculated based on the area, of the plurality of toner images having the different densities, in accordance with a difference between an area of reflected waveform data of a high-density toner image and an area of reflected waveform data of a low-density toner image.

9. The apparatus according to claim 6, wherein when toner amounts of a plurality of toner images having different densities are to be measured, the calculator determines a toner image, the toner amount of which is to be calculated based on the peak position, and a toner image, the toner amount of which is to be calculated based on the area, of the plurality of toner images having the different densities, in accordance with a difference between a peak position of reflected waveform data of a high-density toner image and a peak position of reflected waveform data of a low-density toner image.

10. The apparatus according to claim 6, wherein when the density of the toner image to be formed is low, the calculator weights the area rather than the peak position and calculates the toner amount based on the peak position and the area, and when the density of the toner image to be formed is high, the calculator weights the peak position rather than the area, and calculates the toner amount based on the peak position and the area.

11. The apparatus according to claim 6, wherein a pitch of the photoreceptors which are arranged adjacent to each other is not more than a product of an optical magnification of a condensing lens of the image capturing section and a mean particle diameter of toner.

12. An image forming apparatus comprising:

an image forming section, configured to form a toner image on an image carrying member; and a measuring apparatus which is described in claim 1.

13. An image forming apparatus comprising:

an image forming section, configured to form a toner image on an image carrying member; and a measuring apparatus which is described in claim 6.

14. A method for measuring a toner amount of a toner image formed on an image carrying member of an image forming apparatus, the method comprising:

irradiating the toner image with light;

capturing the toner image using a plurality of photoreceptors arranged adjacent to each other;

acquiring information associated with peak positions of reflected waveforms and information associated with light amounts of the reflected waveforms from data obtained by receiving light reflected by the toner image by the plurality of photoreceptors; and calculating the toner amount based on:

(i) information associated with a density of the toner image to be formed, and (ii) at least one of: (i) the peak position and (ii) the light amount.

15. The method according to claim 14, wherein the acquiring of information associated with the light amount comprises acquiring information associated with peak heights of the reflected waveforms and/or areas of the reflected waveforms.

16. A non-transitory computer-readable medium storing a computer executable instructions which, when run on a computer, cause the computer to measure a toner amount of a toner image formed on an image carrying member of an image forming apparatus, the instructions comprise:

instructions to irradiate the toner image with light;

instructions to capture the toner image using a plurality of photoreceptors arranged adjacent to each other;

instructions to acquire information associated with peak positions of reflected waveforms and information associated with light amounts of the reflected waveforms from data obtained by receiving light reflected by the toner image by the plurality of photoreceptors; and instructions to calculate the toner amount based on:

(i) information associated with a density of the toner image to be formed, and (ii) at least one of: (a) the peak position and (b) the light amount.

* * * * *